US012674291B2

(12) United States Patent
Sicking

(10) Patent No.: US 12,674,291 B2
(45) Date of Patent: Jul. 7, 2026

(54) GUARDRAIL TERMINAL AND GUARDRAIL ASSEMBLY

(71) Applicant: Sicking Safety Systems LLC, Indian Springs Village, AL (US)

(72) Inventor: Dean L. Sicking, Indian Springs Village, AL (US)

(73) Assignee: Sicking Safety Systems LLC, Indian Springs Village, AL (US)

( * ) Notice: Subject to any disclaimer, the term of this patent is extended or adjusted under 35 U.S.C. 154(b) by 229 days.

(21) Appl. No.: 18/408,554

(22) Filed: Jan. 9, 2024

(65) Prior Publication Data

US 2024/0229388 A1 Jul. 11, 2024

Related U.S. Application Data

(60) Provisional application No. 63/479,140, filed on Jan. 9, 2023.

(51) Int. Cl.
*E01F 15/14* (2006.01)

(52) U.S. Cl.
CPC ..... *E01F 15/146* (2013.01)

(58) Field of Classification Search
CPC ... E01F 15/04; E01F 15/0407; E01F 15/0423; E01F 15/0461; E01F 15/0492; E01F 15/143; E01F 15/145; E01F 15/146
USPC ..... 256/13.1; 404/6
See application file for complete search history.

(56) References Cited

U.S. PATENT DOCUMENTS

| | | | | |
|---|---|---|---|---|
| 5,078,366 | A * | 1/1992 | Sicking | E01F 15/143 256/13.1 |
| 5,791,812 | A * | 8/1998 | Ivey | E01F 15/143 256/13.1 |
| 6,022,003 | A * | 2/2000 | Sicking | E01F 15/143 256/13.1 |
| 6,089,782 | A * | 7/2000 | Bligh | E01F 15/143 404/6 |
| 6,173,943 | B1 * | 1/2001 | Welch | E01F 15/143 256/13.1 |
| 6,220,575 | B1 * | 4/2001 | Lindsay | E01F 15/143 256/13.1 |
| 6,715,735 | B2 * | 4/2004 | Bligh | E01F 15/143 256/13.1 |
| 6,783,116 | B2 * | 8/2004 | Albritton | E01F 15/143 256/13.1 |
| 9,145,943 | B2 * | 9/2015 | Sicking | E01F 15/145 |
| 11,466,415 | B2 * | 10/2022 | Sicking | E01F 15/143 |

* cited by examiner

*Primary Examiner* — Josh Skroupa
(74) *Attorney, Agent, or Firm* — Studebaker Brackett PLLC

(57) ABSTRACT

A corrugated guardrail, guardrail terminal, and support post designs that work to control a vehicle during collisions. Embodiments include folding and/or flattening of the corrugated guardrail and controlling the folded and flattened guardrail to avoid intrusion into the vehicle.

20 Claims, 27 Drawing Sheets

GUARDRAIL TERMINAL AND GUARDRAIL ASSEMBLY

CROSS-REFERENCE TO RELATED APPLICATIONS

This application claims the benefit of Provisional Application No. 63/479,140, filed on Jan. 9, 2023, the contents of which are incorporated herein by reference in their entirety.

TECHNICAL FIELD

This disclosure relates to guardrails for roads.

BACKGROUND

Guardrail terminals have three functions: anchor an end of a guardrail barrier to provide sufficient tension to redirect vehicles striking on a face of the guardrail; reduce the risk associated with end-on impacts with the terminal; and either slow impacting vehicles to a safe stop or allow them to penetrate behind the guardrail in a controlled manner. A corrugated guardrail, which includes a W-beam guardrail, is a membrane barrier system that relies on tension in a rail element to capture vehicles striking the face of the barrier. If the guardrail terminal does not provide an adequate anchor that can carry tension in the guardrail during an impact, the barrier system cannot fulfill its primary function of steering cars away from roadside hazards. Impact with the guardrail terminal can produce high deceleration rates, vehicle rollover, and penetration or intrusion into the occupant compartment. All these behaviors can produce fatalities or serious injuries. Accordingly, reducing the risk of and, if possible, preventing such behavior is preferred. Unfortunately, the roadside safety community has to date failed to appreciate the inherent risk of allowing a vehicle to gate through a terminal and travel behind the guardrail at high speed.

Guardrail terminals must mitigate the risk of vehicles striking the end of the terminal. The severity of end-on impacts can be reduced by providing a controlled collapse of the railing system. In conventional controlled collapse systems, the controlled collapse technology will become unstable any time the vehicle path is not perfectly aligned with the guardrail. In such situation, conventional terminals allow vehicles to penetrate through the end of the barrier, often without dissipating significant amounts of energy. In such conventional configurations, the terminal is designed to "gate" open, and vehicles are allowed to travel behind the barrier at a high rate of speed. However, guardrails are used exclusively to protect motorists from roadside hazards, such as bridge piers, drop offs, steep embankments, or bodies of water. Hence, there is always a significant risk for vehicles traveling behind the barrier at a high rate of speed. In fact, the Fatal Accident Reporting System (FARS), operated by the National Highway Traffic Safety Administration in cooperation with the 50 states, the District of Columbia, and Puerto Rico, indicates that approximately 90 fatal crashes occur every year where striking a guardrail terminal is the first harmful event and the most harmful event was related to another off-road risk, such as those listed above. Gating through to a backside of a guardrail terminal represents approximately one third of the total number of fatal accidents associated with guardrail terminals.

The first energy absorbing guardrail terminal, the ET-2000, was introduced in the late 1980's. This terminal incorporated an impact head that fit over the end of the guardrail and, when struck by a car, the head was forced down the W-beam. As the guardrail was pushed through the impact head, it passed through a squeezer section and was flattened. The flattened guardrail was then curled out of the back of the impact head. The squeezing and curling of the guardrail dissipated large amounts of energy and thereby slowed impacting vehicles in a controlled manner. In-service performance studies of this terminal demonstrated outstanding safety performance and this terminal was adopted widely across the US and some foreign countries, including Canada and Australia. Competitors soon came to market, including the beam eating steel terminal (BEST), sequential kinking terminal (SKT), and the Flared Energy Absorbing Terminal (FLEAT). All these designs provided energy absorption using a mechanism other than flattening, but the basic concept of using an impact head to slide down the rail, deform it, and deflect it out of the vehicle's path was included in each of these designs.

Each of these energy absorbing terminals produce compression in the guardrail as the impact head is pushed forward. Unfortunately, the compression forces can become excessive and cause the guardrail to buckle. When the guardrail buckles, the energy dissipation stops immediately and a 180-degree bend in the rail often develops. This type of bend is sometimes called a "knee" and this bend or knee can penetrate into an impacting vehicle and seriously injure or kill the occupants. A knee can also deform the occupant space such that occupants are injured by large deformations of the occupant space. This behavior has been labelled "intrusion" of the occupant space.

In 1999, the concept of a tension guardrail terminal was introduced. Although no product was brought to market, a patent was obtained on a device that incorporated an impact head that forced the guardrail to the ground and allowed vehicles to pass over the guardrail. The end of the barrier was permanently attached to a ground anchor to maintain tension in the guardrail system. By maintaining tension in the guardrail, the system could prevent buckling and thereby eliminate spearing or intrusion. Also, the impact head will tend to follow along the guardrail's path, which means the vehicle will be steered back toward the roadway. The first commercial implementation of this concept, called the "Soft Stop," was introduced almost a decade later and included a vertical compression of the W-beam as a primary energy absorber.

For tension guardrail terminals to function properly, they must maintain a strong, positive, or continuous connection with the vehicle throughout the impact. Unfortunately, the most popular tension-based guardrail terminal cannot create a strong mechanical interlock between the terminal's impact head and the front of an impacting vehicle. The most popular tension-based guardrail terminal also includes a steel tube attached to the impact head that extends under the impacting vehicle. The passing of the vertically compressed guardrail through the tube provides significant friction forces near the ground line. Impact forces are delivered near the center of gravity of the vehicle while the resistance forces from the W-beam are much closer to the ground. These two forces produce an overturning moment in the impact head which causes the tube under the vehicle to lift up and function as a spear to penetrate the oil pan, gas tank, or even the floorboard of an impacting vehicle. The head rotation also causes the impact plate to tilt backwards to produce a ramp that allows the impacting vehicle to ride up and over the terminal. Hence, Applicant appreciated that a non-gating guardrail terminal must be capable of keeping the guardrail under tension and producing a strong mechanical interlock between the end of the terminal and the front of the impacting vehicle without puncturing critical components of the vehicle.

The first tension-based energy absorbing guardrail system was introduced in late 2006. In theory, a tension-based guardrail terminal cannot cause the rail to buckle and thus should greatly reduce the risk of spearing or intrusion into the occupant space. The first tension terminal incorporated a cable that was threaded along a torturous path that produces friction to slow impacting vehicles. The cable is attached to a ground anchor to prevent buckling of the guardrail and reduce the risk of penetration or intrusion of the occupant compartment. Further, this terminal system was designed to minimize the number of vehicles that travel behind the guardrail and encounter roadside hazards. Unfortunately, the attempt to capture more vehicles involved stiffening the terminal to the point that the safety performance for head-on impacts was compromised.

More recently, a patent application for a canister guardrail was submitted to the USPTO. This design incorporates a squeezing system that flattens the guardrail and directs it into a round barrel where it is retained inside the impact head. This concept allows the terminal energy absorption rate to increase as the impact head is pushed further into the system. The downside of this impact attenuation system is that it cannot be restarted after a moderate impact. The reason this system cannot be restarted is that the entire coil of guardrail inside the impact head must rotate around the inside of the barrel for the energy management system to function. There is simply too much static friction between adjacent coils and too much inertia to resist restarting of the energy management process, once stopped. Even if the terminal head is still aligned with the guardrail, the energy management system cannot restart after even a relatively minor impact.

Additional problems that plague some existing guardrail terminals include steel bearing plates, used in most compression-based terminals, and steel posts cutting open the floor pan when impacting vehicles pass over the anchor or line posts during head-on crashes. Further, most guardrail terminals have difficulty providing adequate anchorage for vehicles striking the system on the face of the barrier near the end of the guardrail. Eliminating the need for a bearing plate and a detachable first post reduces the risk of cutting into a vehicle's floor pan.

SUMMARY

This disclosure provides a guardrail terminal comprising a first end, a second end, an impact face, a top plate, a bottom plate, an opening, a pair of side plates, and a deflector. The first end includes an opening configured to accept a corrugated shaped guardrail. The impact face is positioned at the second end. The impact face includes a front surface facing away from the first end, a back surface facing toward the first end, and a bottom surface. The top plate extends from the first end to the impact face. The bottom plate extends from the first end toward the impact face. The opening is formed between the bottom plate and the back surface of the impact face. The pair of side plates extends from the top plate to the bottom plate on opposite sides of the top plate and the bottom plate. The deflector is attached to the top plate and to a lower location on the back surface of the impact face. The deflector extends at an angle of at least 15 degrees downwardly from the top plate toward the back surface of the impact face.

This disclosure also provides a guardrail terminal comprising a first end, a second end, a plurality of walls, an opening, a passage, and an angled deflector. The plurality of walls extends between the first end and the second end and includes a top wall and a bottom wall. The opening is formed in the first end by the plurality of walls. The passage has a vertical width formed by the plurality of walls extending from the opening to the second end. The angled deflector is attached to the top wall and extends across the vertical width of the passage.

This disclosure also provides a guardrail terminal comprising a plurality of walls, a plate, at least one side wall, and a plurality of engagement pins. The plurality of walls is configured to peripherally enclose a guardrail. The plurality of walls extends in a longitudinal direction. The plate extends in a direction transverse to the longitudinal direction and is connected to the plurality of walls. At least one side wall is connected to the plate and extends in a first direction away from the plurality of walls. The plurality of engagement pins is supported by at least one of the plate and the at least one side wall. The plurality of engagement pins extends away from the plate in the first direction.

Advantages and features of the embodiments of this disclosure will become more apparent from the following detailed description of exemplary embodiments when viewed in conjunction with the accompanying drawings.

DETAILED DESCRIPTION

Figure 1:
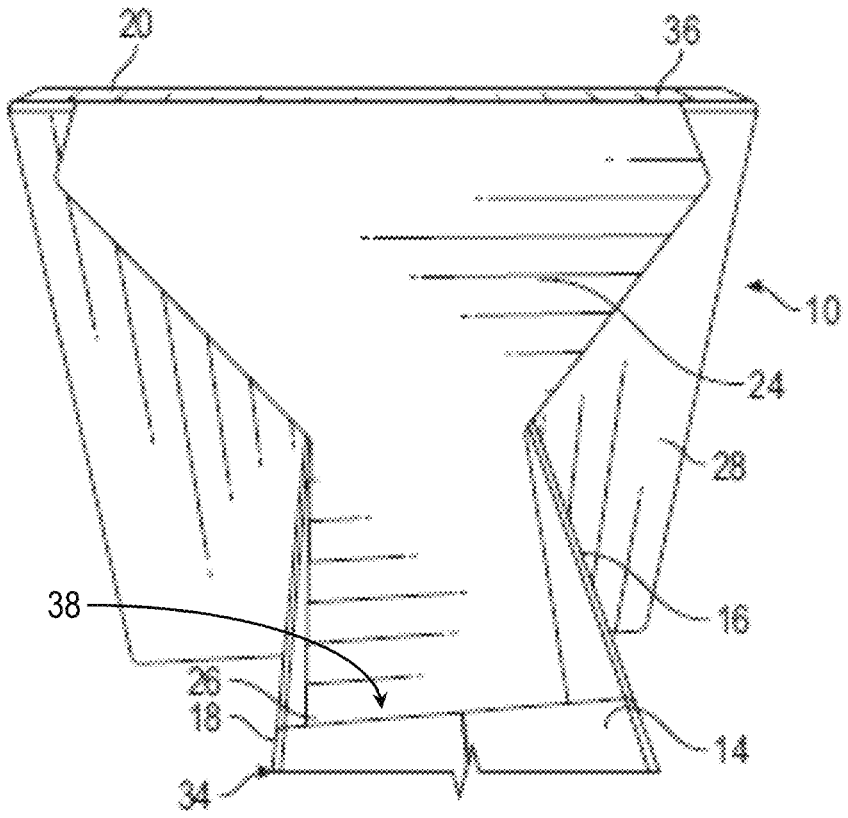
FIG. 1 shows a bottom view of a portion of a guardrail terminal in accordance with an exemplary embodiment of the present disclosure.

The present disclosure presents embodiments of folding guardrail terminal designs that are configured to fold a guardrail beam from an unfolded state to a folded state during a collision or impact on an impact plate or face of a terminal of the guardrail. In other words, the guardrail of the present disclosure is in an unfolded state prior to a collision or impact with the guardrail terminals of the present disclosure, simplifying installation and assembly over designs that require partial or complete folding of the guardrail beam during assembly of the guardrail beam and the guardrail terminal while maintaining the advantages of predetermined folding of the guardrail beam during impact or collision. The folding guardrail terminal shows improved performance over conventional designs, decreasing the likelihood of serious injury and/or death from impact on a guardrail equipped with the presently disclosed guardrail terminals, especially such injuries and/or death that might otherwise occur due to gating through the guardrail during an impact.

The present disclosure also discloses features related to the guardrail terminal. Such features include, for example, an impact face of the guardrail terminal, support mechanisms for the guardrail and guardrail terminal, and other mechanisms associated with the guardrail and guardrail terminal.

In the context of this disclosure, the term "guardrail" and "guardrail beam" should be taken as being synonymous. The term "guardrail assembly" should be considered to be elements of a guardrail along with, for example, guardrail anchor or support posts, guardrail terminal, anchor cable, anchor cable support post, and release plate. To the extent that this disclosure may use the terms "unit," "member," and other such terms that may inappropriately be considered "nonce" terms, these terms should be considered to invoke, for example, guardrail, guardrail assembly, guardrail terminal, guardrail terminal assembly, anchor post, anchor cable, reverse release plate, and the like to the extent applicable in context to the description and related claims.

After deep study and analysis of existing terminal designs, Applicant came to understand that conventional designs, while they work well for their intended purpose, have certain limitations. For example, to steer an impacting vehicle, a tension-based guardrail terminal can utilize an impact head that buries itself into the front of an impacting vehicle. Because the impact head can only pull laterally on the front of the vehicle, there is a strong propensity for the vehicle to spin-out and become detached from the impact head. This propensity is magnified by the decelerating forces applied to the impact head as the guardrail is forced through it. If a terminal is to capture most vehicles striking the end of the impact head, considering the substantial variation in size, weight, center-of-gravity, etc., there must be a balance between the lateral forces that pull the front of the vehicle back toward the roadway and the deceleration forces applied to the impact head by the guardrail.

Applicant further came to understand that there is a relatively narrow range of lateral force (steering force) and longitudinal force (deceleration force) combinations that allow a guardrail terminal to safely capture most impacting vehicles. Because both lateral and longitudinal forces clearly affect the gating action of the terminal, and because these forces are relatively independent of one another as a matter of design, their combined effect becomes the critical determinant between gating and non-gating performance. Applicant conducted an extensive effort that included both a full-scale crash testing program and a non-linear finite element modeling analysis that were combined to identify the relationships between decelerations and various guardrail post designs that can be expected to prevent gating for most passenger vehicles impacting at angles of 15 degrees or less.

Turning now to FIGS. 1-9, guardrail terminals in accordance exemplary embodiments of the present disclosure are shown.

Figure 2:
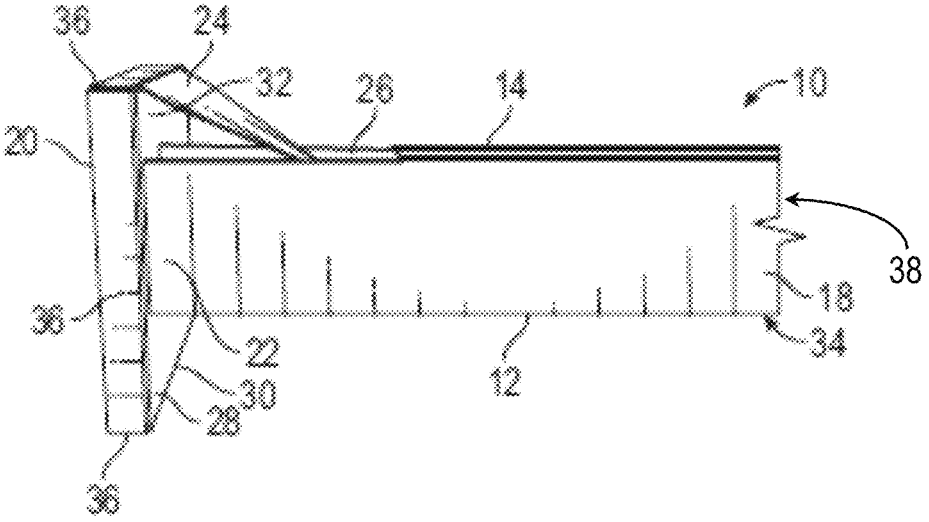
FIG. 2 shows a side view of the guardrail terminal of FIG. 1.
Figure 3:
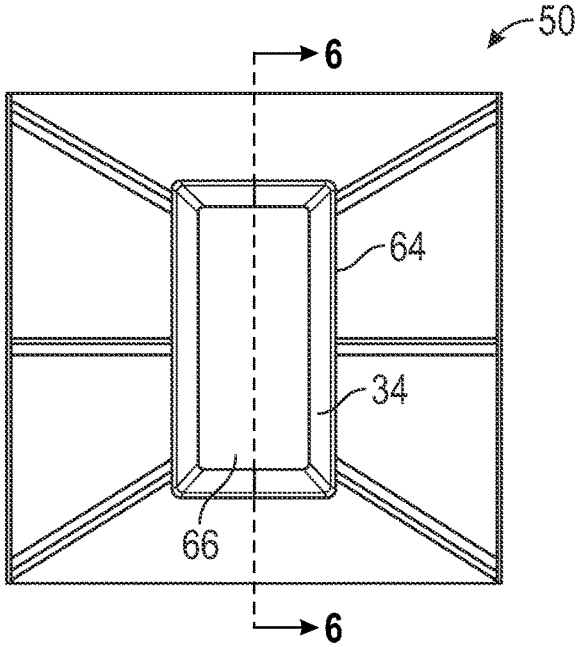
FIG. 3 shows a view of a guardrail terminal from a feeder chute end of the guardrail terminal in accordance with another exemplary embodiment of the present disclosure.
Figure 4:
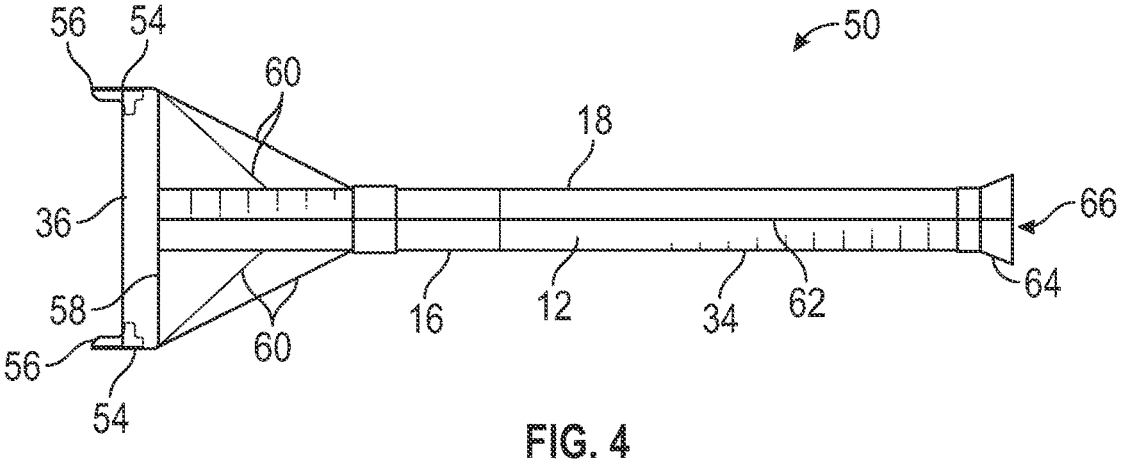
FIG. 4 shows a top view of the guardrail terminal of FIG. 3.
Figure 5:
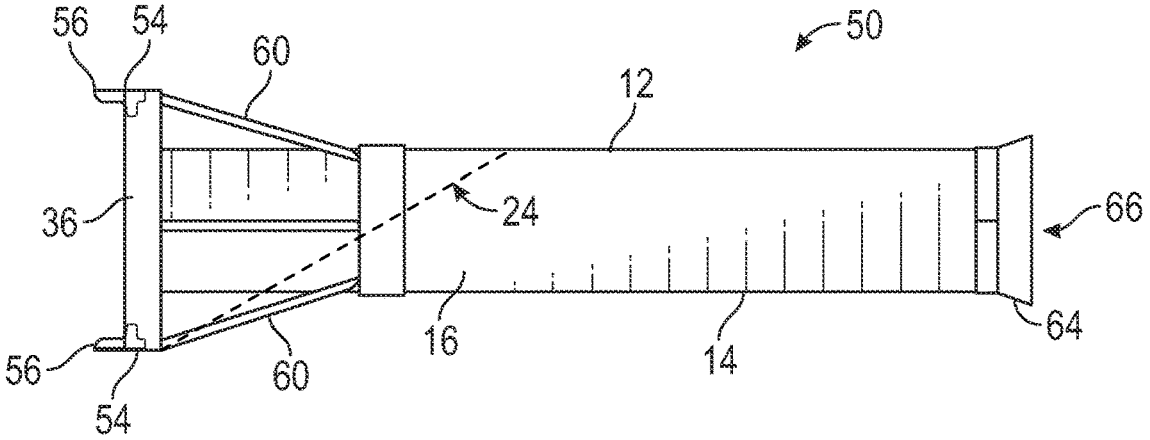
FIG. 5 shows a side view of the guardrail terminal of FIG. 3.
Figure 6:
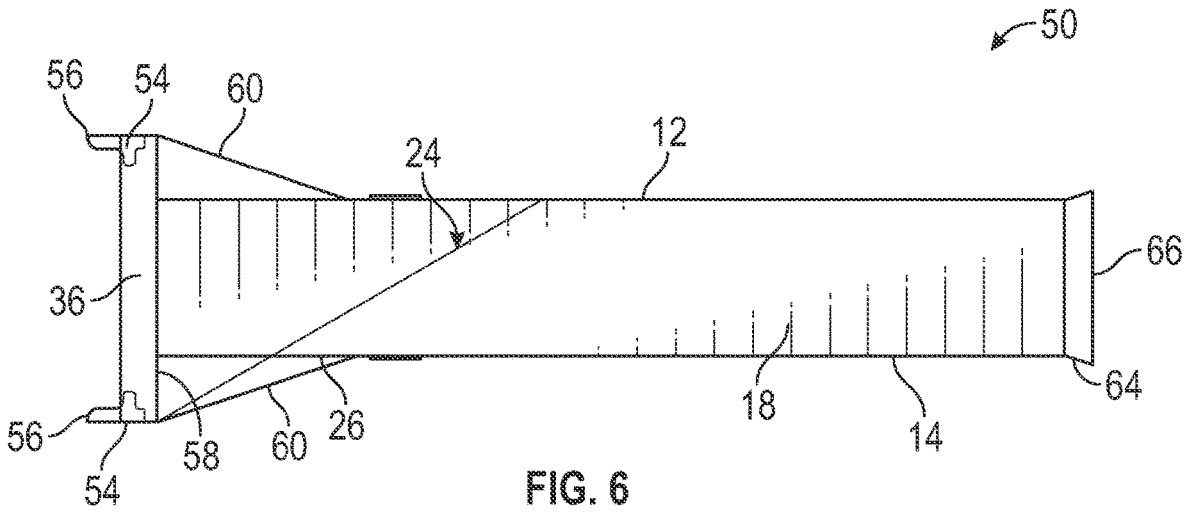
FIG. 6 shows a sectional view of the guardrail terminal of FIG. 3 along the lines 6-6.
Figure 7:
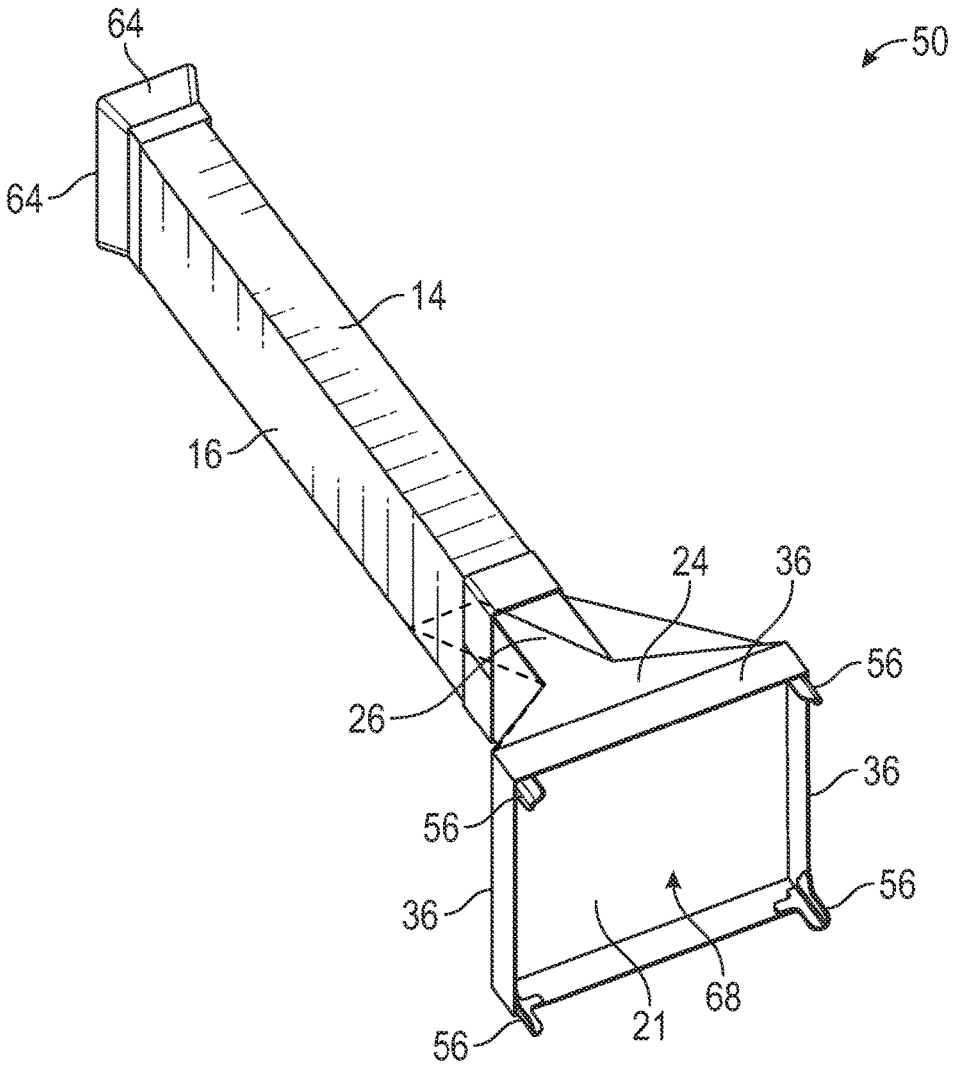
FIG. 7 shows a perspective view of the guardrail terminal of FIG. 3.

FIGS. 1 and 2 show views of a guardrail terminal 10 of the present disclosure in accordance with an exemplary embodiment of the present disclosure. Guardrail terminal 10 includes a feeder chute 34, which may also be described as a guide chute, and an impact face 20 attached at a first end 22 of feeder chute 34. Impact face 20, which can also be described as impact plate 20, extends in a direction transverse to a longitudinal or long direction of guardrail terminal 10. Feeder chute 34 includes a top plate 12, a bottom plate 14, and a pair of side walls or plates 16 and 18 that extend between respective edges of top plate 12 and bottom plate 14. Plates 12, 14, 16, and 18 form a passage 38 into which a guardrail is positioned. Accordingly, the guardrail is enclosed peripherally by the plurality of walls or plates. Impact face 20 includes a back surface 28, which includes an upper end 30 and a lower end 32.

Guardrail terminal 10 also includes a deflector plate 24 attached to top plate 12 and angled between 15 and 45 degrees from the horizontal to extend downwardly from top plate 12 through an opening 26 formed in feeder chute 34 between bottom plate 14 and back surface 28 of impact face 20. Opening 26 is also bounded on each side by side plates 16 and 18. Deflector plate 24 is attached to top plate 12 by way of, for example, welding, though fasteners can also be used. Deflector plate 24 is attached to back surface 28 of impact face 20. Impact face 20 can include a plurality of side walls 36 that extend around a periphery of impact face 20 in a direction that is away from impact face in a direction opposite to back surface 28, and deflector plate 24 can extend across a lower side wall 36 and be attached, for example by way of welding, to lower side wall 36. Accordingly, deflector plate 24 extends from one side of feeder chute 34 to an opposite side of feeder chute 34. Deflector plate 24 is also attached to side walls or plates 16 and 18 of feeder chute 34 by way of, for example, welding. It should be noted that while internal welding to side walls 16 and 18 is a preferred configuration, welding can also be to external surfaces of side walls 16 and 18. Such can be accomplished by, for example, slitting side walls 16 and 18 and either welding to the exposed edge of deflector plate 24, or forming a tab on deflector plate 24 and inserting the tab into the slitting. Other techniques to weld deflector plate 24 to either an internal or external surface of side walls 16 and 18 are envisioned.

In addition, deflector plate 24 is positioned directly between feeder chute 34 and impact face or plate 20. While a small portion of deflector plate 24 may extend lower than impact face 20, such is not necessary because the flattening of the corrugated guardrail occurs prior to the flattened guardrail exiting opening 26.

Guardrail terminal 10 is positioned on an end of a guardrail, as will be discussed herein. When a vehicle collides or hits impact face 20, guardrail terminal 10 begins to slide along the guardrail, which, as indicated hereinabove, is a corrugated guardrail beam. Such beams include three folds to form a W-shape and five folds. As deflector plate 24 is forced along the guardrail, the guardrail is collapsed by deflector plate 24 into a stack to form a compressed corrugated shape. The compressed guardrail is forced along deflector plate 24 through opening 26 toward the ground below the guardrail, permitting a colliding vehicle to pass over the compressed corrugated shape.

The angles of deflector plate 24 permits adjustability of deceleration forces. The shallower the angle, in other words, as the angle approaches 15 degrees from the horizontal, lower deceleration forces are generated as compared to higher or steeper angles. Conversely, as the angle of deflector plate 24 approaches 45 degrees, deceleration forces increase.

FIGS. 3-7 show views of a guardrail terminal 50 in accordance with another exemplary embodiment of the present disclosure. Features of guardrail terminal 50 that are similar to the features of guardrail terminal 10 are labeled with the same number for consistency. Guardrail terminal 50 includes an impact face 68 having a back surface 58. Positioned in each corner 54 of impact face 68, at a periphery of impact face 68, is an engagement pin 56. Also, engagement pins 56 can be positioned at adjacent corners 54 of impact face 68. Guardrail terminal 50 is attached to feeder chute 34, similar to guardrail terminal 10. However, guardrail terminal 50 also includes a plurality of gussets 60, which can extend from back surface 58 to top plate 12, side plate 16, and side plate 18. Gussets 60 provide strength to impact face 20 to reduce the amount of bending about a longitudinal axis 62 of guardrail terminal 50 in both the horizontal and vertical directions.

Guardrail terminal 50 includes a flared collar 64 that is attached to downstream entrance 66. It should be noted that in the vernacular of guardrail terminals that downstream is toward and/or along the guardrail and upstream is toward impact face 20. Flared collar 64 forms an angled or conical shape to improve acceptable admittance of the guardrail into guardrail terminal 50 even if guardrail terminal 50 is pushed out of plane relative to the incoming guardrail, i.e., if guardrail terminal 50 is misaligned with an ideal position of longitudinal axis 62.

Guardrail terminals 10 and 50, and other guardrails disclosed herein, are an energy-absorbing interface between the corrugated guardrail and the impacting vehicle. Guardrail terminals may also be described as an impact head or terminal head. The guardrail terminals disclosed herein are designed to absorb energy by changing the shape of the guardrail and allowing it to exit from, for example, bottom plate 14 by way of opening 26. Deflector plate 24 is specifically designed to push the guardrail toward the ground as it comes out of the front of the impact head to prevent significant vehicle ride up. The upstream end of guardrail terminal 50 is reinforced, for example, by gussets 60, and designed to produce substantial mechanical interlock with the impacting vehicle. Such interlock is by way of sidewalls 36 in guardrail terminal 10 and by sidewalls 36 and engagement pins 56 in guardrail terminal 50. This mechanical interlock is partially dependent on engagement pins 56, which lock into the vehicle structure at impact of the vehicle with impact face 20 of guardrail terminal 50.

Flared collar 64 helps reduce gouging of the corrugated guardrail as it feeds into feeder chute 34. Guardrail terminal 50 is designed to provide an average stopping force of approximately 13-16 kip-ft/ft, where kip is one thousand pounds. Engagement pins 56 are connected to impact face 20, either directly to a front surface 21 of impact face 20, by way of side walls 36, or to both impact face 20 and to side walls 36. Engagement pins 56 are meant to be the first point of contact with the vehicle when the terminal is engaged. Engagement pins 56 protrude far enough from front surface 21 that they are capable of puncturing the steel frame of the vehicle, such as the bumper cross member, locking the guardrail terminal 50 in place while the engagement of guardrail terminal 50 with the guardrail decelerates and steers the vehicle back toward the road, helping to prevent gating crashes. Engagement pins 56 are typically welded to front surface 21 of impact face 20. However, engagement pins 56 could be supported in a bracket (not shown) that is attached or welded to impact face 20, including front surface 21 and/or side walls 36 at the front of guardrail terminal 50.

FIGS. 8-13 show views of guardrail terminals 80 and 82 that include an impact face 84. Features of guardrail terminals 80 and 82 that are similar to guardrail terminals 10 and 50 are provided with the same reference numerals for simplicity of explanation. However, it should be noted that various embodiments disclosed herein are combinable with each other since one embodiment can typically be modified with features of other embodiments. Impact face 84 includes six engagement pins 56. Engagement pins 56 are positioned in corners 54, as with guardrail terminal 50, but are also positioned approximately halfway between an uppermost engagement pin 56 and a lowermost engagement pin 56 on each side of impact face 84. The six pins provide increased engagement with an impacting vehicle as compared to four pins.

Figure 10:
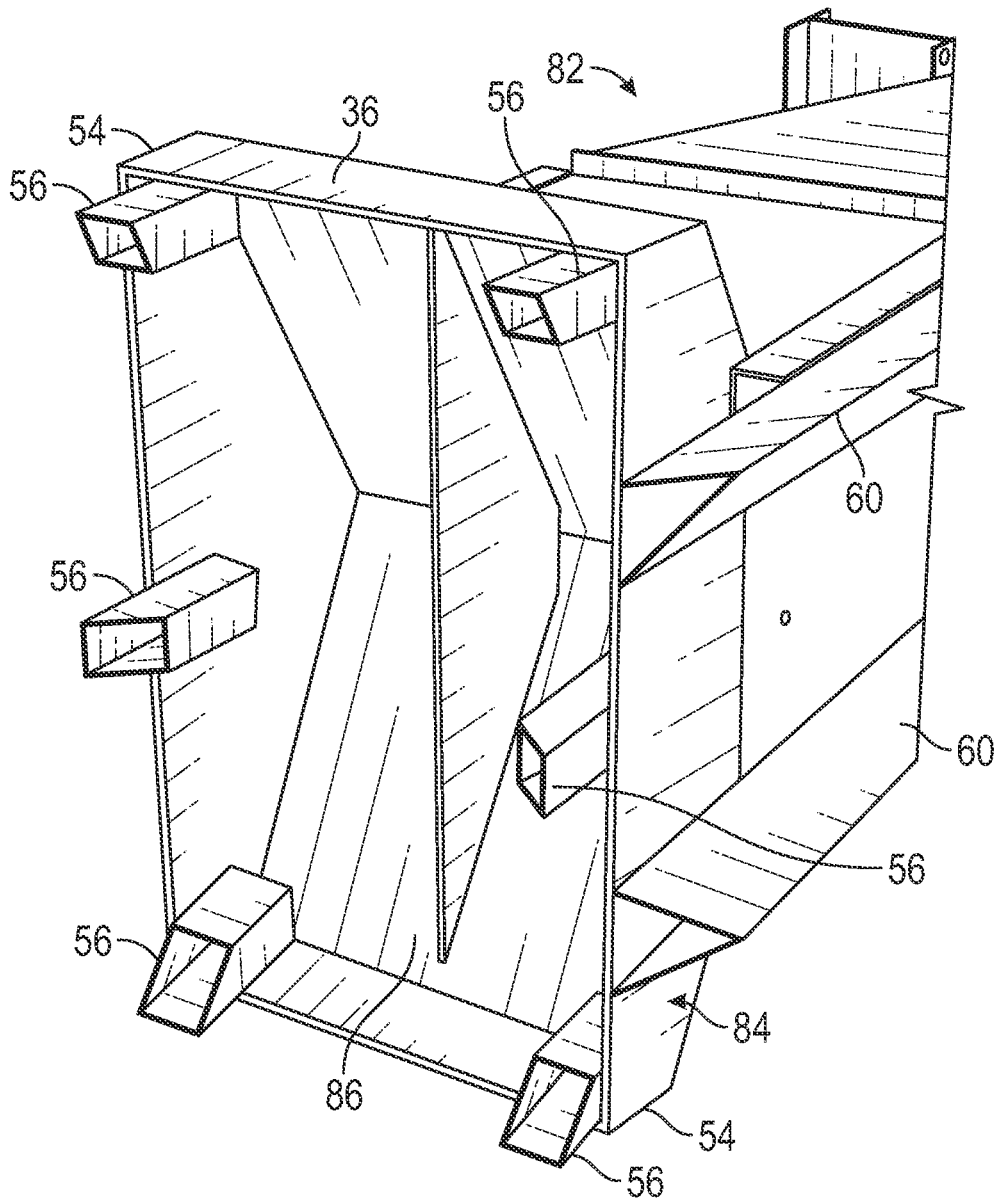
FIG. 10 shows a perspective view of an impact face of a guardrail terminal in accordance with yet another exemplary embodiment of the present disclosure.
Figure 11:
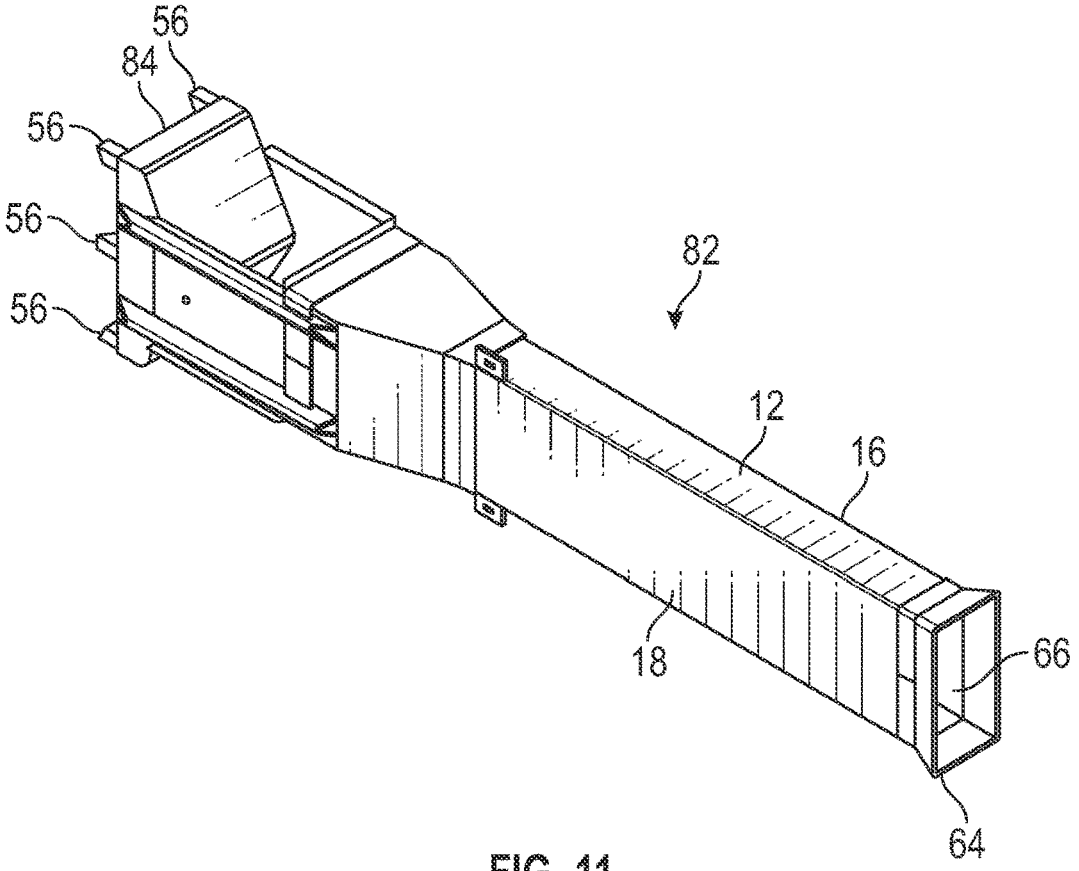
FIG. 11 shows perspective view of the guardrail terminal of FIG. 10.
Figure 12:
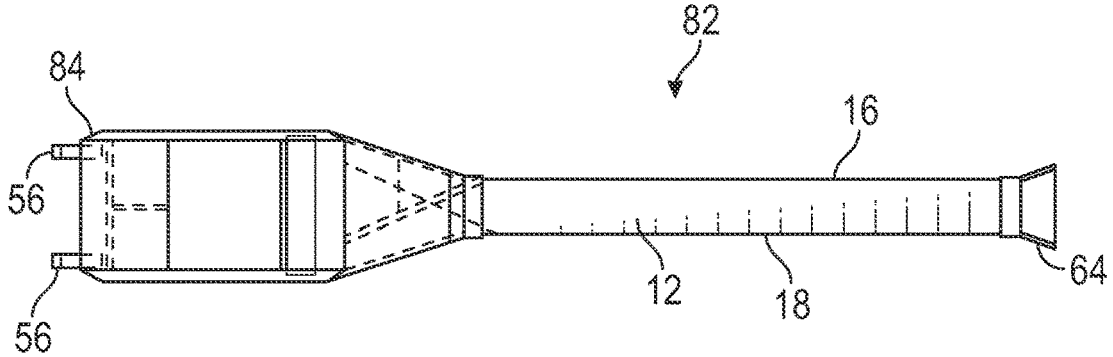
FIG. 12 shows a top view of the guardrail terminal of FIG. 10.
Figure 13:
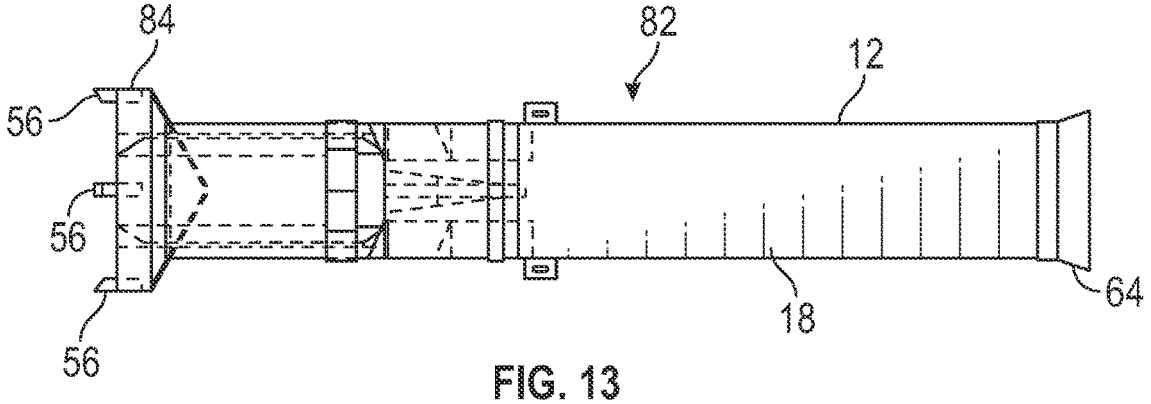
FIG. 13 shows a side view of the guardrail terminal of FIG. 10.

It should be noted that engagement pins 56 can be formed of hollow tubes, such as shown in FIG. 10. Also, engagement pins 56 can be formed with an angle of at least 45 degrees at an end of engagement pins 56 furthest away from an exterior surface 86 of impact face 84. While the angle can theoretically approach 90 degrees, from a practical perspective the length of the pins limits the angles. Accordingly, in an exemplary embodiment the angles of the pins are in a range from 45 degrees to 75 degrees. The angle can be less than 45 degrees. However, an angle of 45 degrees to 75 degrees is more effective in puncturing an impacting vehicle than angles approaching 0 degrees.

Figure 8:
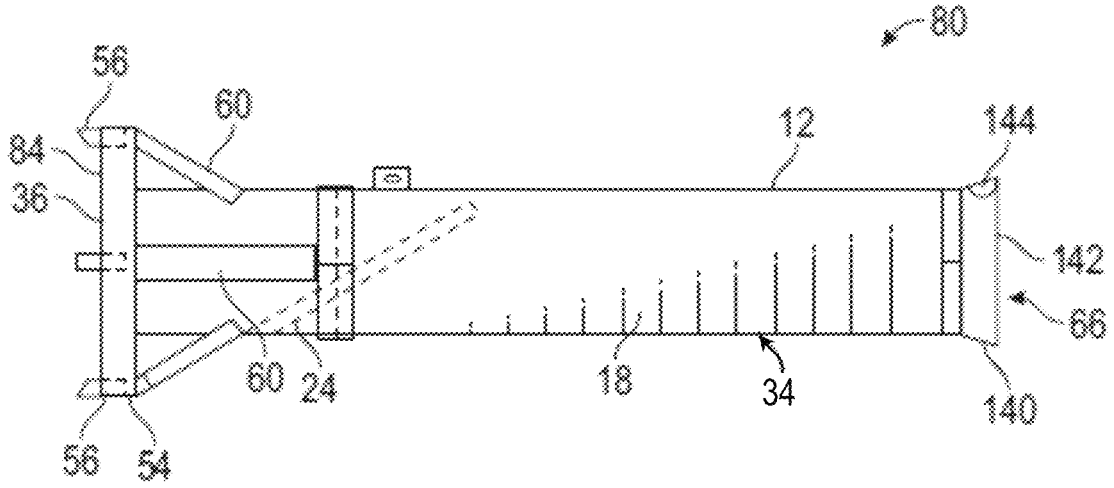
FIG. 8 shows a side view of a guardrail terminal in accordance with a further exemplary embodiment of the present disclosure.
Figure 9:
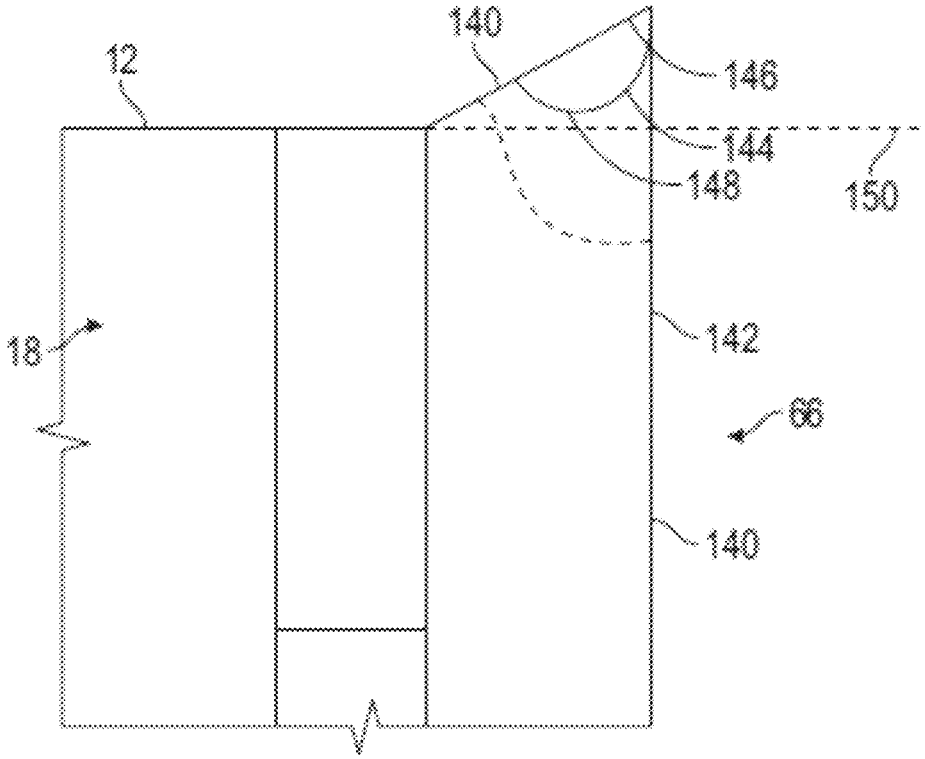
FIG. 9 shows a partial sectional view of an input flange to a feeder chute of the guardrail terminal of FIG. 8.
Figure 18:
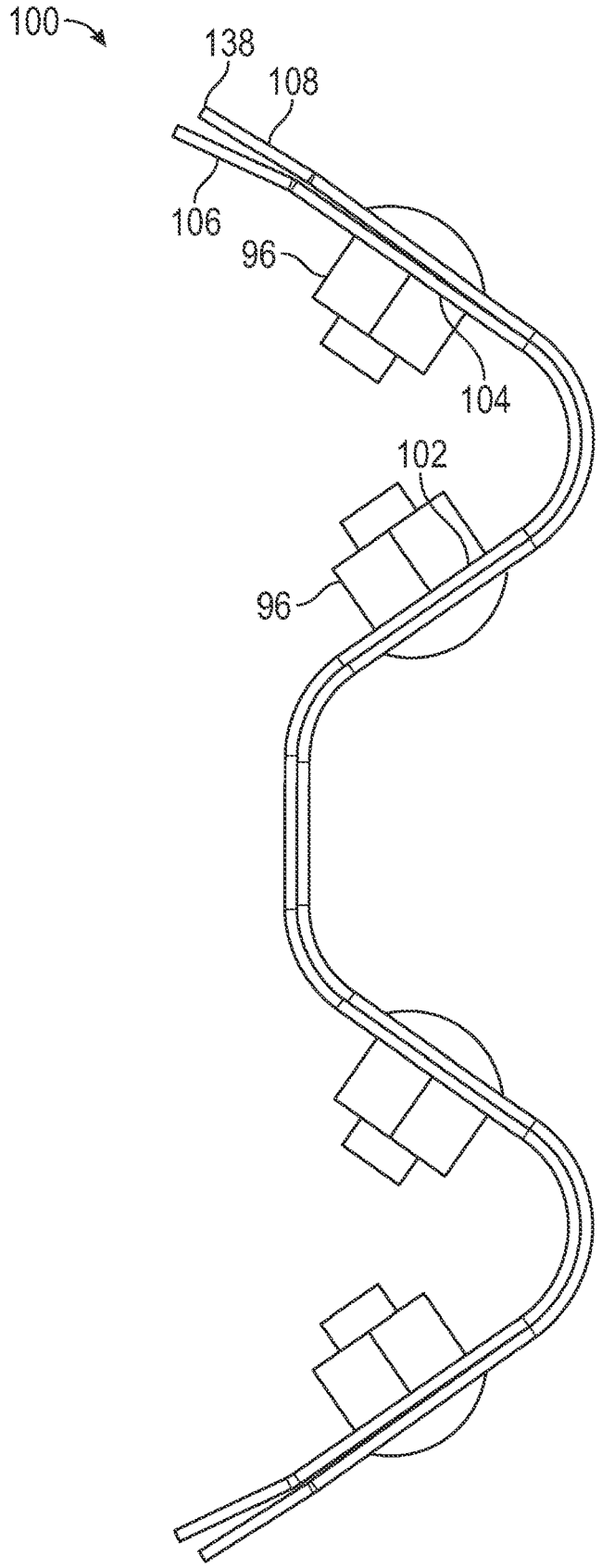
FIG. 18 shows a side view of a corrugated guardrail with the splice of FIG. 14.
Figure 19:
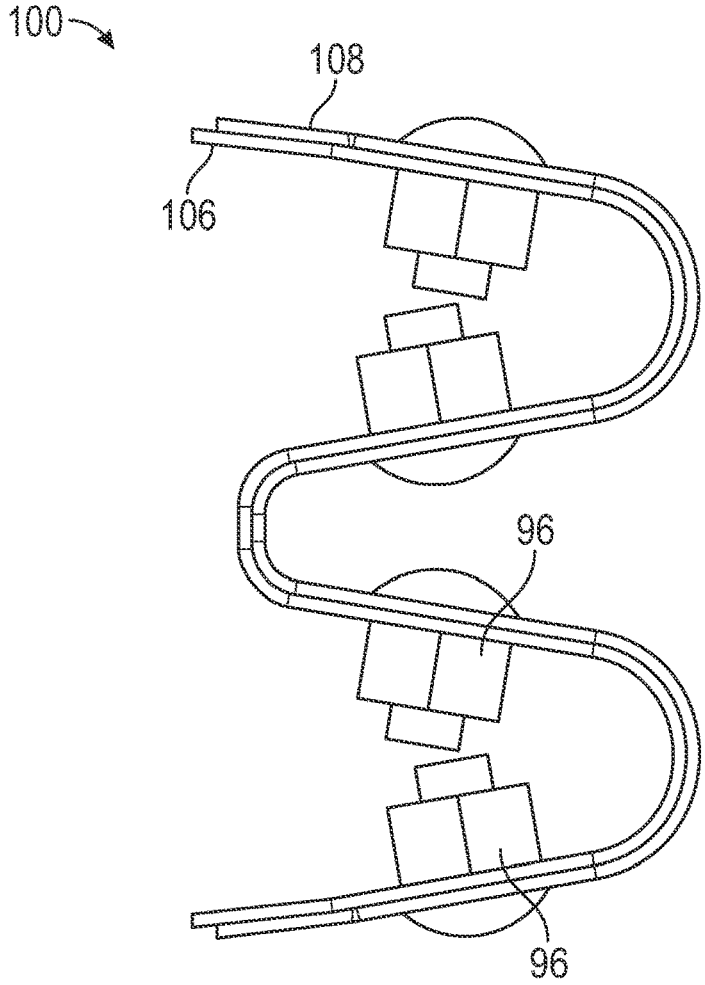
FIG. 19 shows a side view of the corrugated guardrail of FIG. 14 partially compressed by one of the guardrail terminals disclosed herein.
Figure 20:
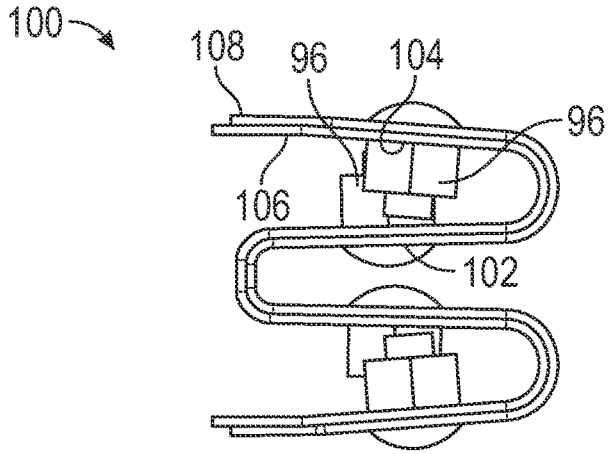
FIG. 20 shows a side view of the corrugated guardrail of FIG. 14 fully compressed by one of the guardrail terminals disclosed herein.

Referring to FIGS. 8 and 9, guardrail terminal 80 includes a unique feature. Upon impact, especially by tall vehicles, a terminal head can pitch forward, with entrance 66 to the guide chute diving down into the upstream guardrail. To prevent the walls of feeder chute 34 from cutting into an upper edge 138 of, for example, first guardrail 108 (see FIGS. 14 and 18), flared collar 140 includes a configuration that promotes contact between a flat, broad face of a bar of steel against sharp upper edge 138 of first guardrail 108. In some situations, such as when first guardrail 108 or second guardrail 106 kinks or bends out of a vertically-extending plane, edge 138 of first guardrail 108 can protrude vertically and can interact with an edge 142 of flared collar 140. To prevent this interaction, an insert 144 can be installed on a broad interior upper face 146 of flared collar 140 between collar 140 and first guardrail 108. One example of insert 144 is a 2-inch pipe cut in half. This halfpipe creates separation between edge 142 of flared collar 140 and edge 138 of first guardrail 108. Insert 144 also promotes a soft contact behind upper edge 138 of first guardrail 108 and round surface 148 of the pipe/insert 144.

As shown in FIG. 9, insert 144 preferably does not extend beyond an imaginary line that extends from an inner surface of top plate or wall 12. Keeping insert 144 above imaginary line 150 maintains clearly for insertion of guardrail 108 into downstream entrance 66.

Figure 16:
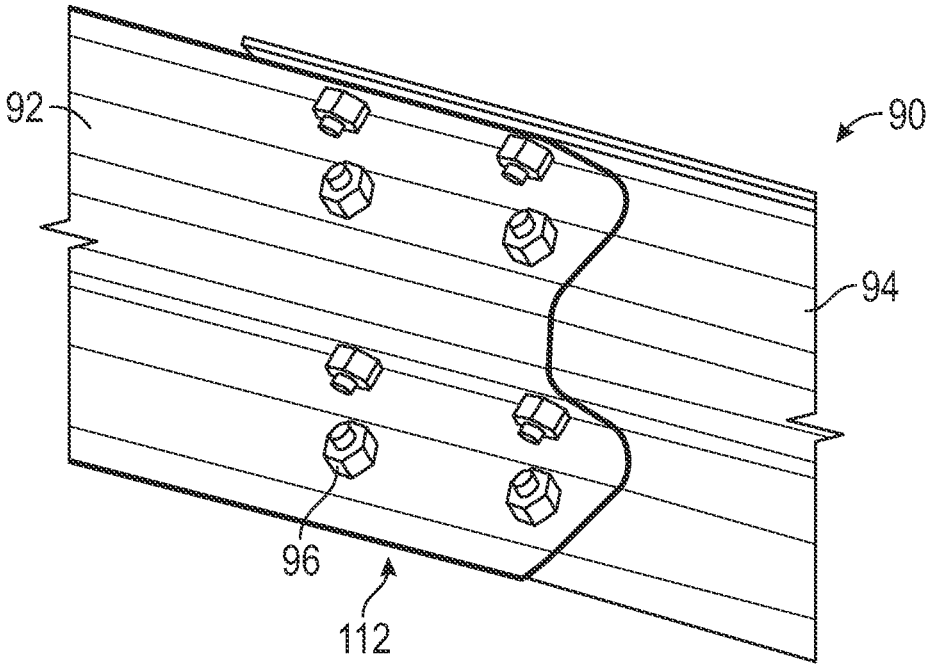
FIG. 16 (Prior Art)
FIG. 16 shows a perspective view of a guardrail splice of a prior art guardrail splice.
Figure 17:
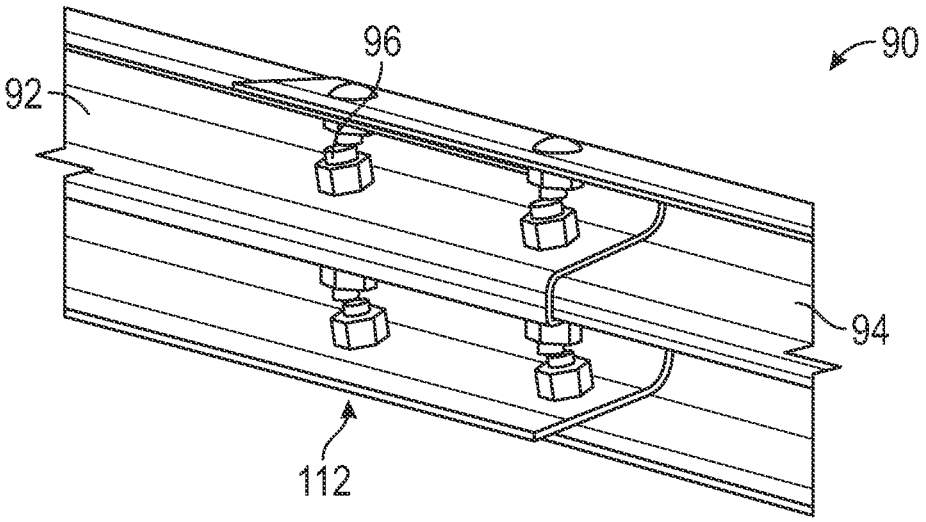
FIG. 17 (Prior Art)
FIG. 17 shows a perspective view of the guardrail splice of FIG. 16 with the guardrail compressed by one of the guardrail terminals disclosed herein.
Figure 21:
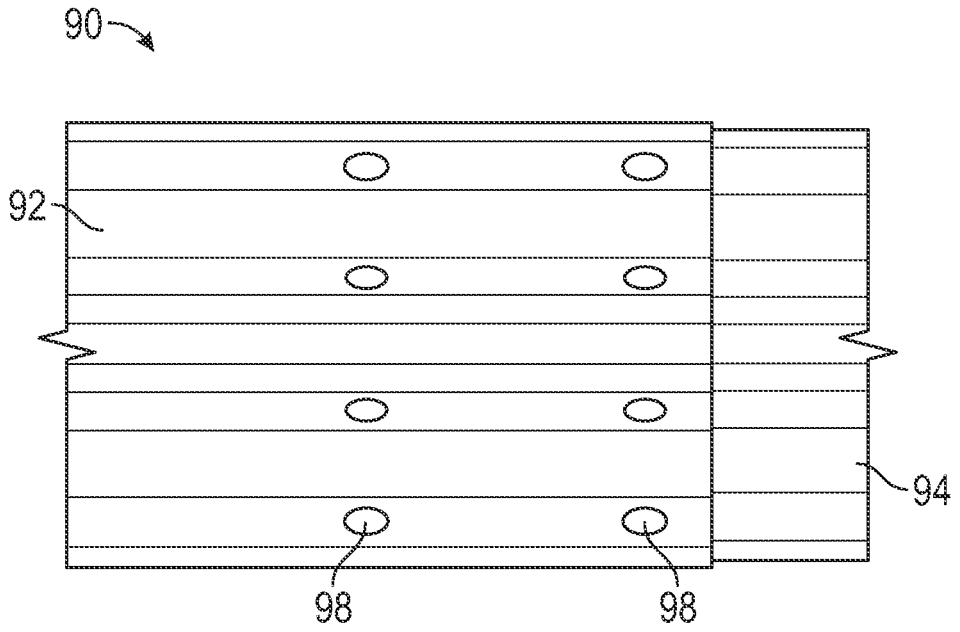
FIG. 21 (Prior Art)
FIG. 21 shows a conventional fastener opening configuration for a guardrail splice.

FIGS. 14, 15, 18-20, and 22 show views of a guardrail splice 100 in accordance with an exemplary embodiment of the present disclosure. In a conventional guardrail splice 90, shown in FIGS. 16 and 17, a first guardrail 92 and a second guardrail 94 are spliced to each other by fasteners 96. As shown in FIG. 21, fastener openings 98, into which fasteners 96 are inserted, are in a vertically-extending line. As guardrail terminal 50 compresses guardrails 92 and 94, which are of a corrugated W-shape, fasteners 96 of splice 90 engage each other, limiting the amount of compression because fasteners 96 are quite strong. Because the conventional splice configuration limits compression, in a conventional configuration, guardrails 92 and 94 retain significant strength in a vertical direction, meaning that the compressed guardrail may not pass under an impacting vehicle. Further, guardrails 92 and 94 may still contain sufficient strength to compromise the passenger compartment of an impacting vehicle, potentially leading to injury to the occupants.

Figure 14:
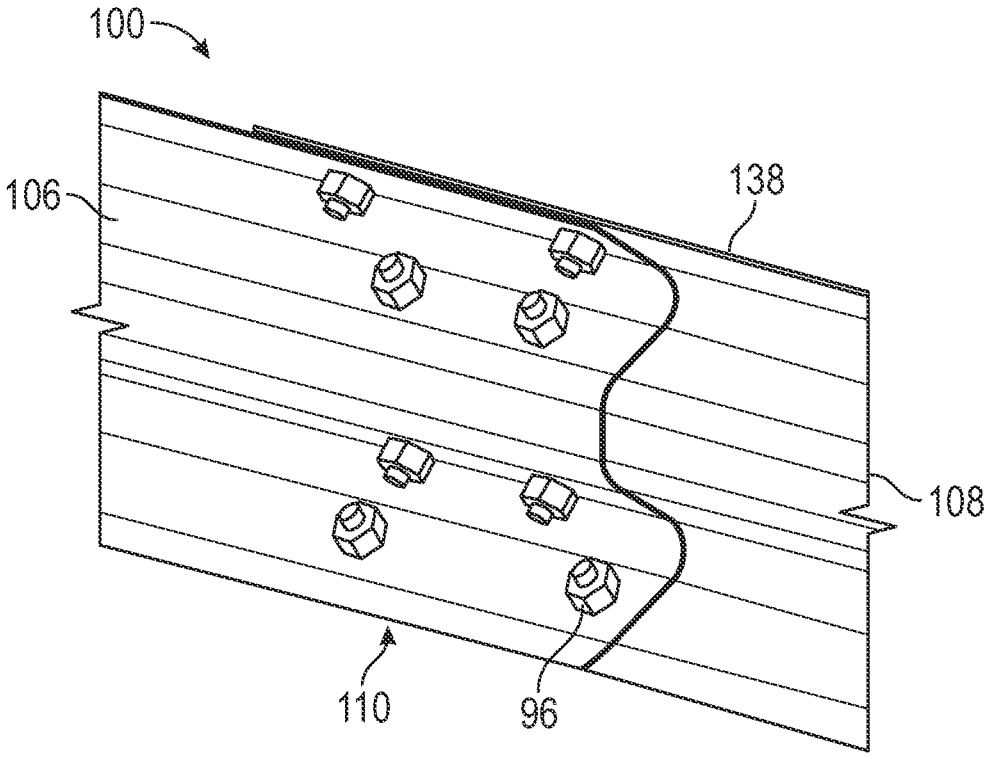
FIG. 14 shows a perspective view of a guardrail splice in accordance with an exemplary embodiment of the present disclosure.
Figure 15:
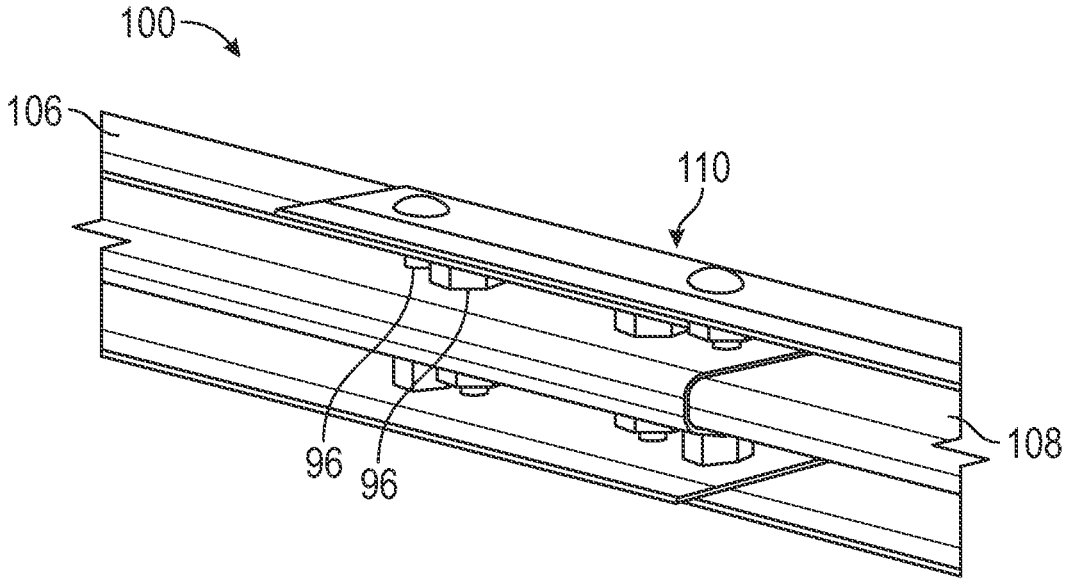
FIG. 15 shows a perspective view of the guardrail splice of FIG. 14 with the guardrail compressed by one of the guardrail terminals disclosed herein.

In contrast, guardrail splice 100 in FIGS. 14, 15, 18-20, and 22 includes inside openings 102 and outside openings 104, and outside openings 104 are offset longitudinally from inside openings 102. In other words, inside openings 102 and outside openings 104 are staggered from each other. Accordingly, as shown in FIGS. 14 and 15, as guardrails 106 and 108 are compressed, for example, by guardrail terminal 50, instead of interfering, fasteners 96 in guardrail splice 100 compress until they reach a surface of either second guardrail 106 or first guardrail 108. Thus, compression of guardrail splice 100 is significantly more than compression of guardrail splice 90. Indeed, the compression of guardrail splice 100 is sufficient that compressed guardrails 106 and 108 no longer have sufficient strength to sustain a horizontal or near horizontal direction, and instead are more easily pushed toward the ground than compressed guardrails 92 and 94, passing under an impacting vehicle.

Figure 22:
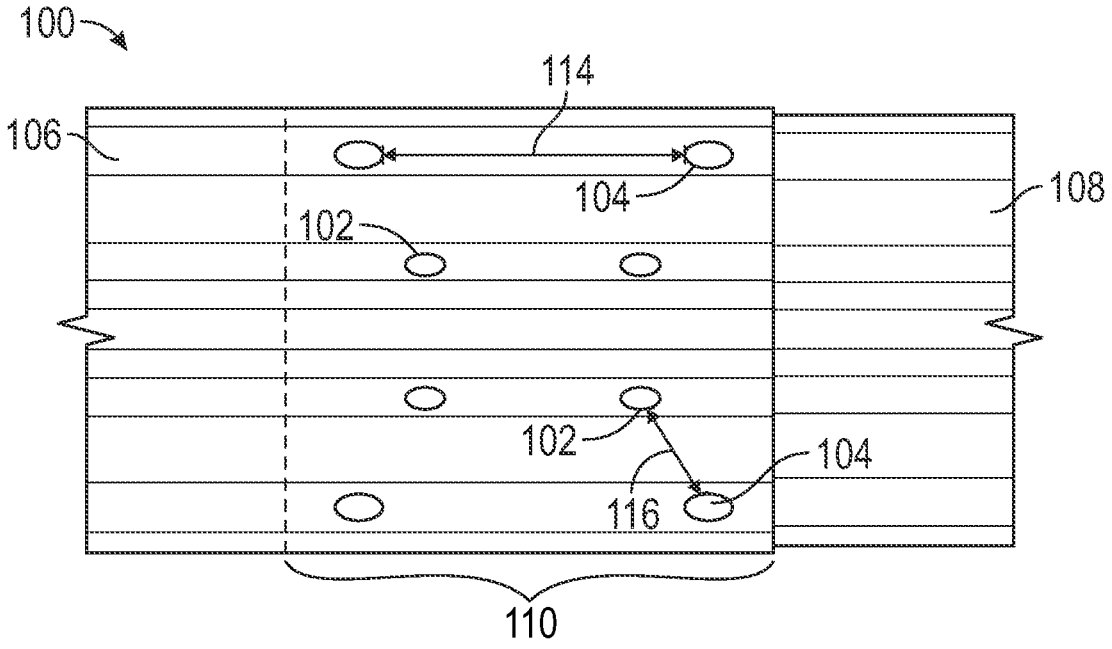
FIG. 22 shows a fastener opening configuration for the guardrail splice configuration of FIG. 14.

Applicant terms this configuration of eight fasteners 96 in the vertically staggered configuration of FIG. 22 "neXt-Splice." In this configuration, top and bottom fasteners 96 are spread out in the longitudinal direction, moving away from the vertical centerline of the overlapping of guardrail 106 and guardrail 108, which is the definition of guardrail splice 110. As can be seen in FIG. 22, when the translation of fasteners 96 is done on both sides of the vertical centerline, the eight fasteners 96 form an "X" shape. This unique splice shape ensures that a standard guardrail splice 90 cannot be used to attach differing thicknesses of guardrail.

This configuration of fasteners 96 provides advantages. As a first advantage, the configuration enables splice 110 to compress to a lower profile than a conventional splice 112. Any time spliced guardrails 106 and 108 are compressed vertically and fed through, for example, guardrail terminal or head 50, the lower profile of splice 110 enables splice 110 to pass through opening 26 more easily. Splice 110 reduces or prevents spikes in force associated with standard splice 112 when guardrails 92 and 94 are compressed. Splice 110 also enables opening 26 in guardrail terminal 50 to be smaller than an opening configured to pass conventional splice 112. Opening 26 must accommodate the thickest portion of rail that passes through it. If splice 110 is staggered and opening 26 is smaller, then opening 26 will become naturally stiffer than a larger opening as well. The lengths of the sides, being made of the same material and structure as used in a wider opening, would be able to endure larger forces, if necessary.

Another advantage is that distances 114 and 116 between edges of openings 104 and edges of openings 102 and 104 increases. This increased distance requires a larger force or energy to create a crack between openings 104 and/or between openings 102 and 104. Because of this increased spacing, splice 110, which is often the weakest part of the guardrail, is strengthened, and the capacity of the guardrail and guardrail terminal increases over a conventional configuration.

Figure 23:
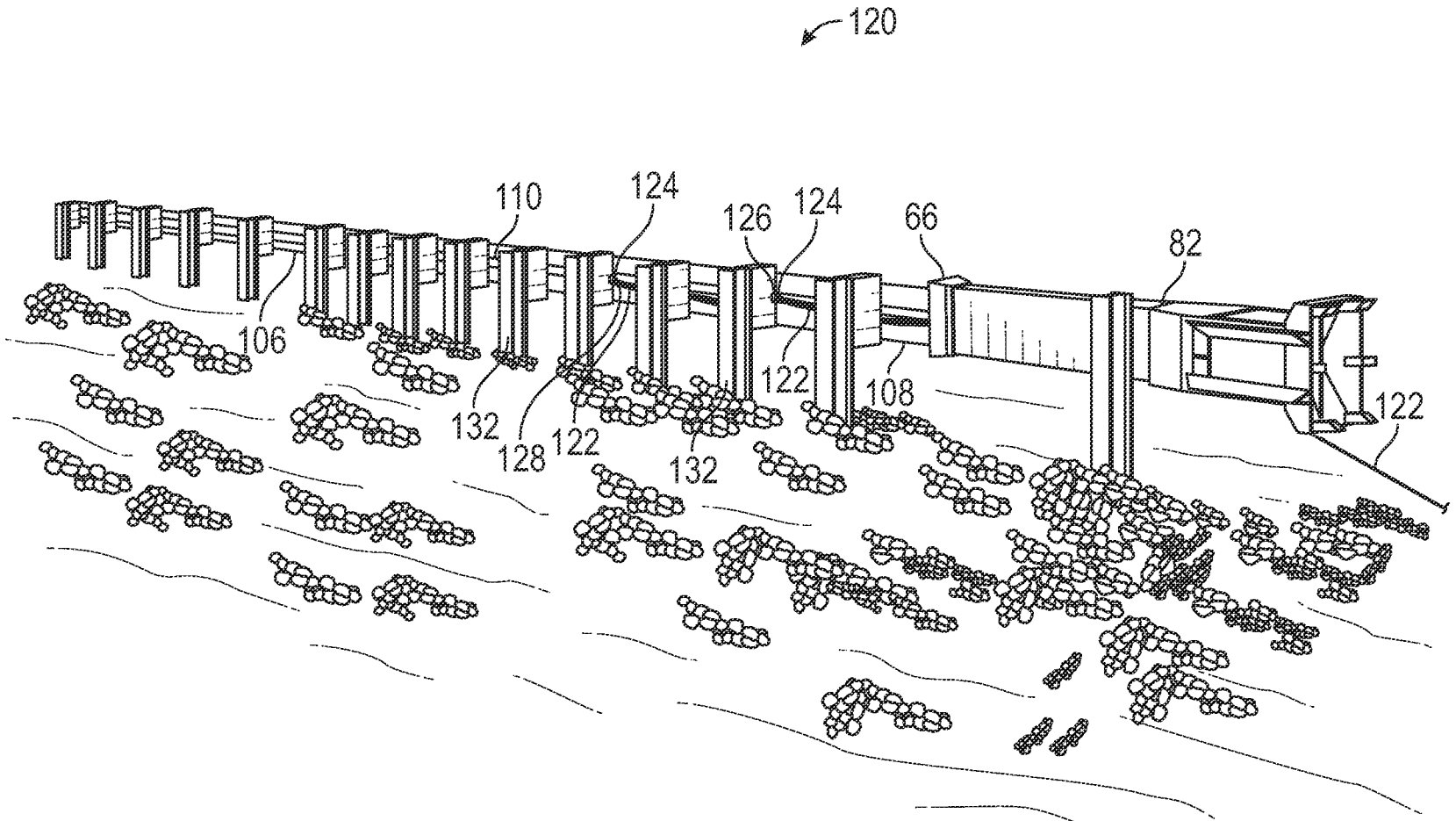
FIG. 23 shows a guardrail assembly in accordance with an exemplary embodiment of the present disclosure.
Figure 24:
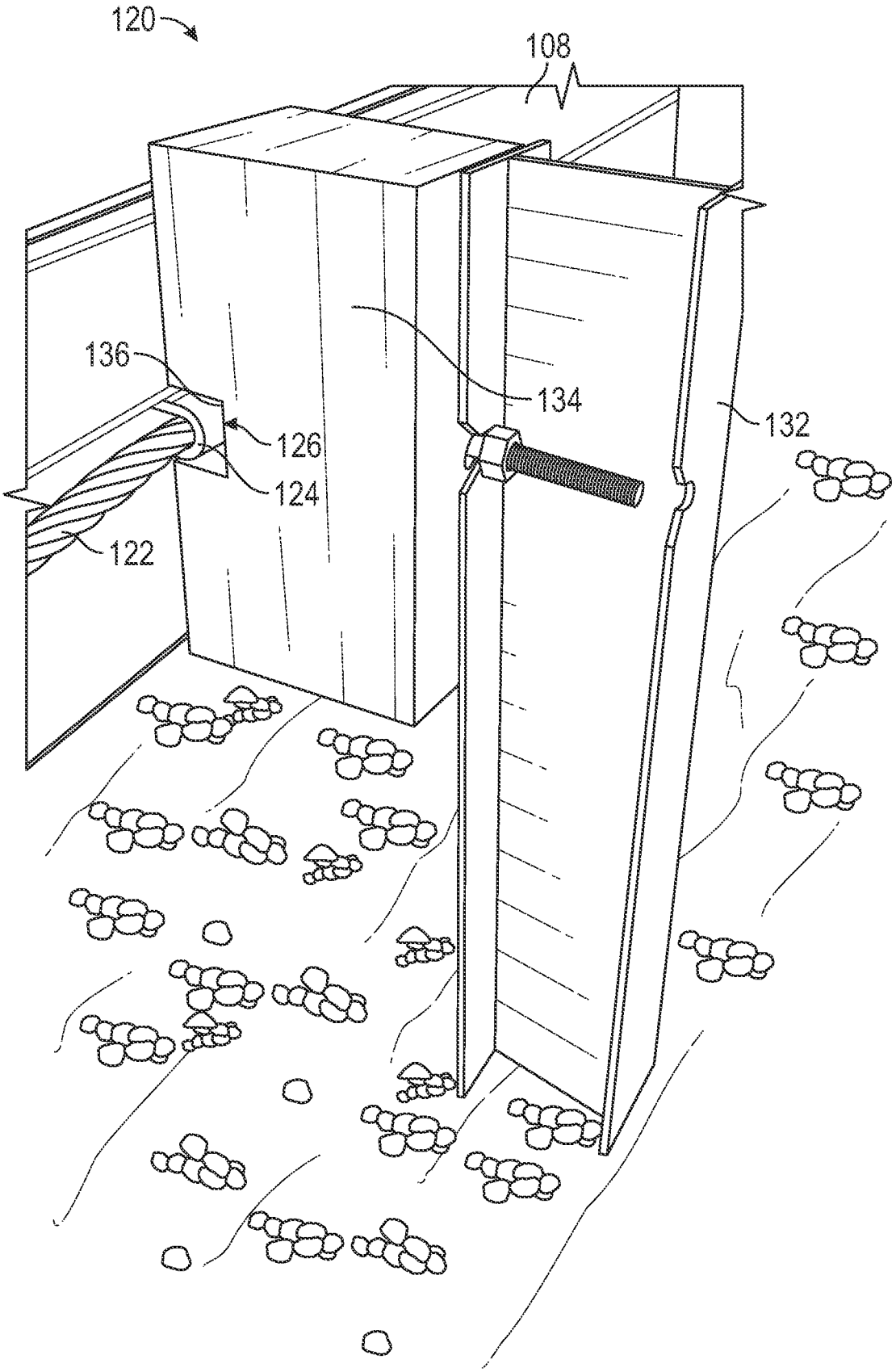
FIG. 24 shows a perspective view of a guardrail post and the interface of the guardrail post with a guardrail.
Figure 25:
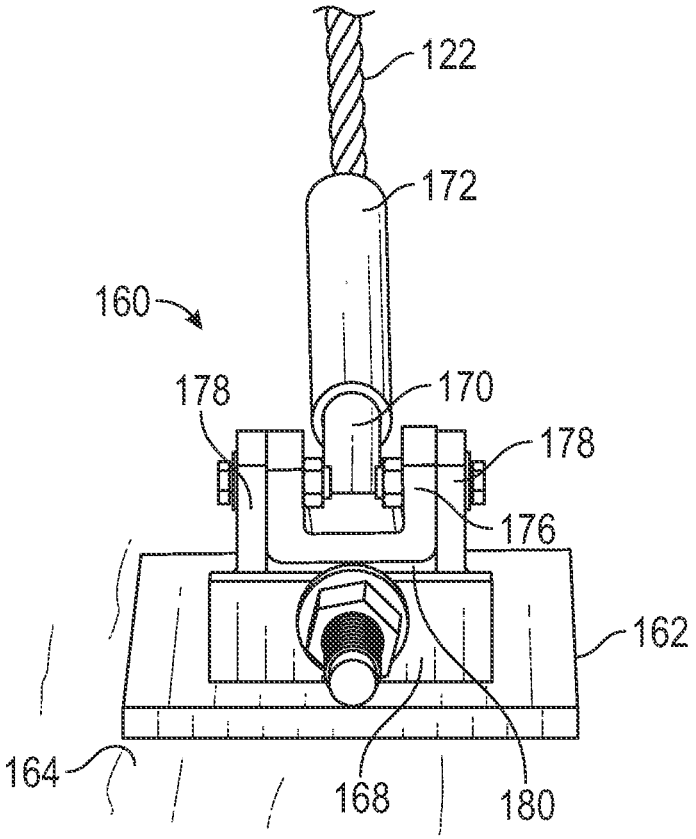
FIG. 25 shows a perspective view of an anchor post connection in accordance with an exemplary embodiment of the present disclosure.
Figure 26:
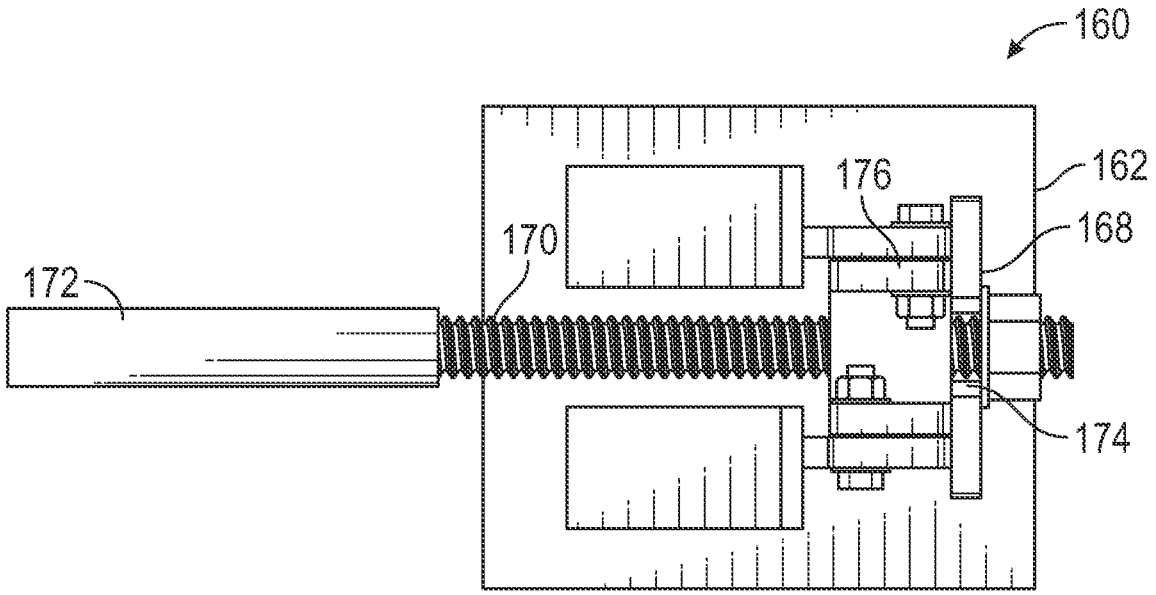
FIG. 26 shows a top plan view of the anchor post of FIG. 25.
Figure 27:
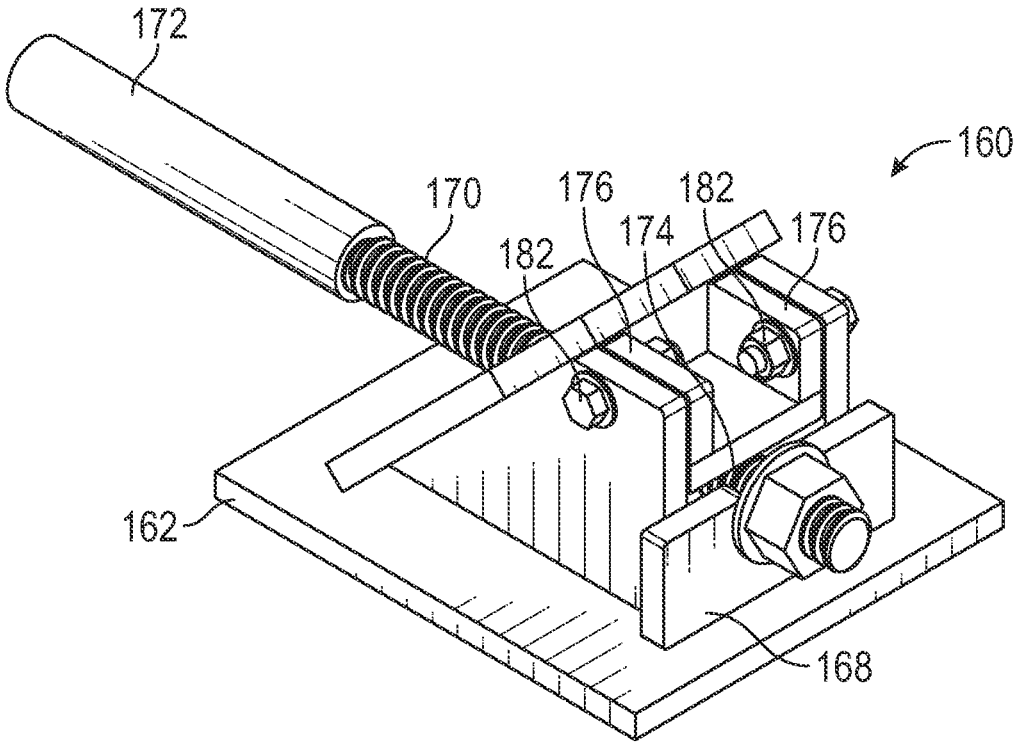
FIG. 27 shows a perspective view of the anchor post of FIG. 25.
Figure 28:
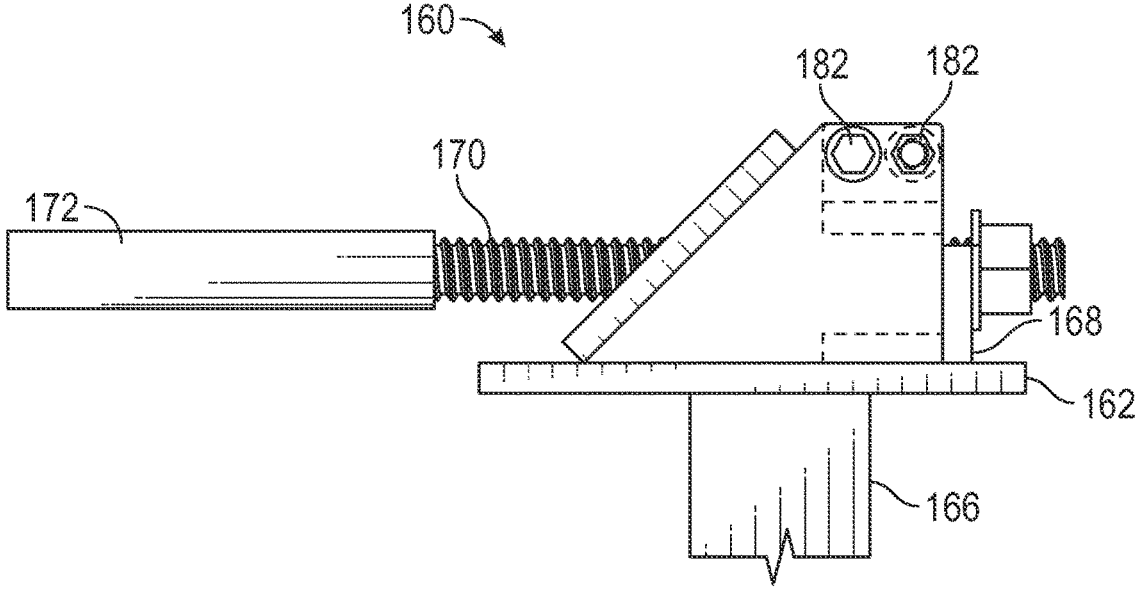
FIG. 28 shows an elevation view of the anchor post of FIG. 25 from a direction perpendicular to a cable anchored by the anchor post.
Figure 29:
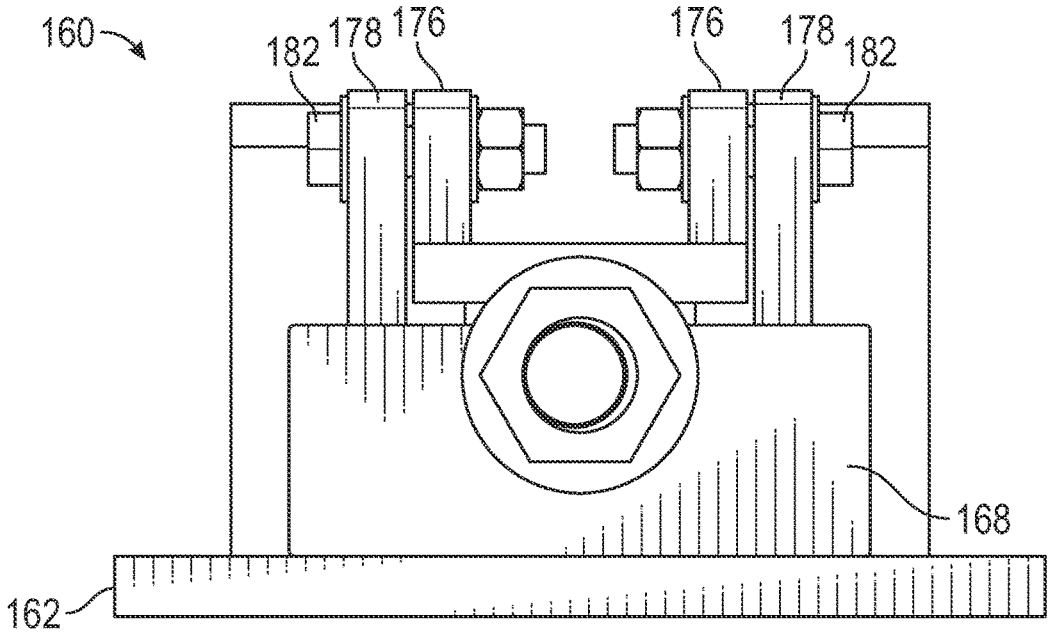
FIG. 29 shows an elevation view of the anchor post of FIG. 25 from a direction parallel to the cable anchored by the anchor post.
Figure 30:
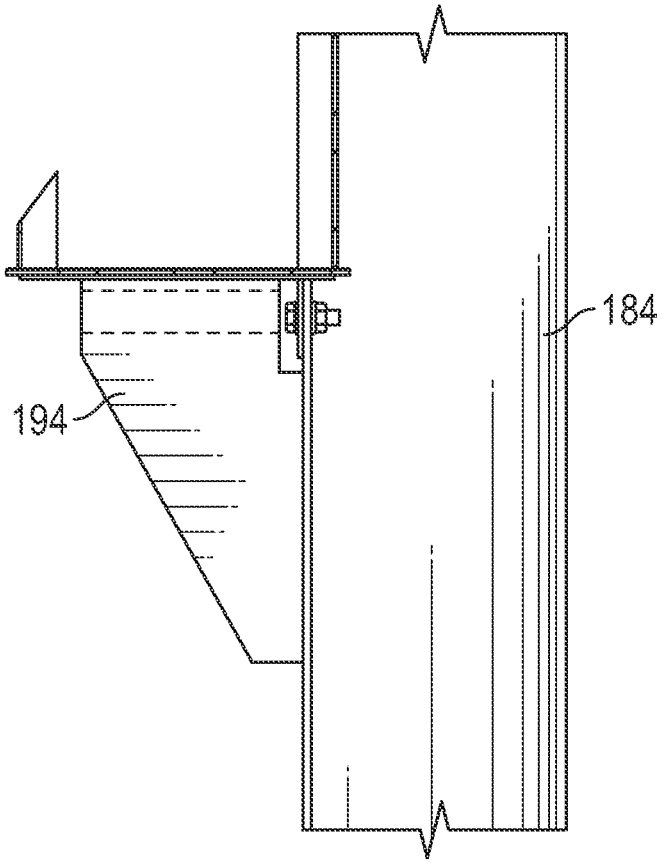
FIG. 30 shows an elevation view of a shelf bracket positioned on a post in accordance with an exemplary embodiment of the present disclosure.
Figure 31:
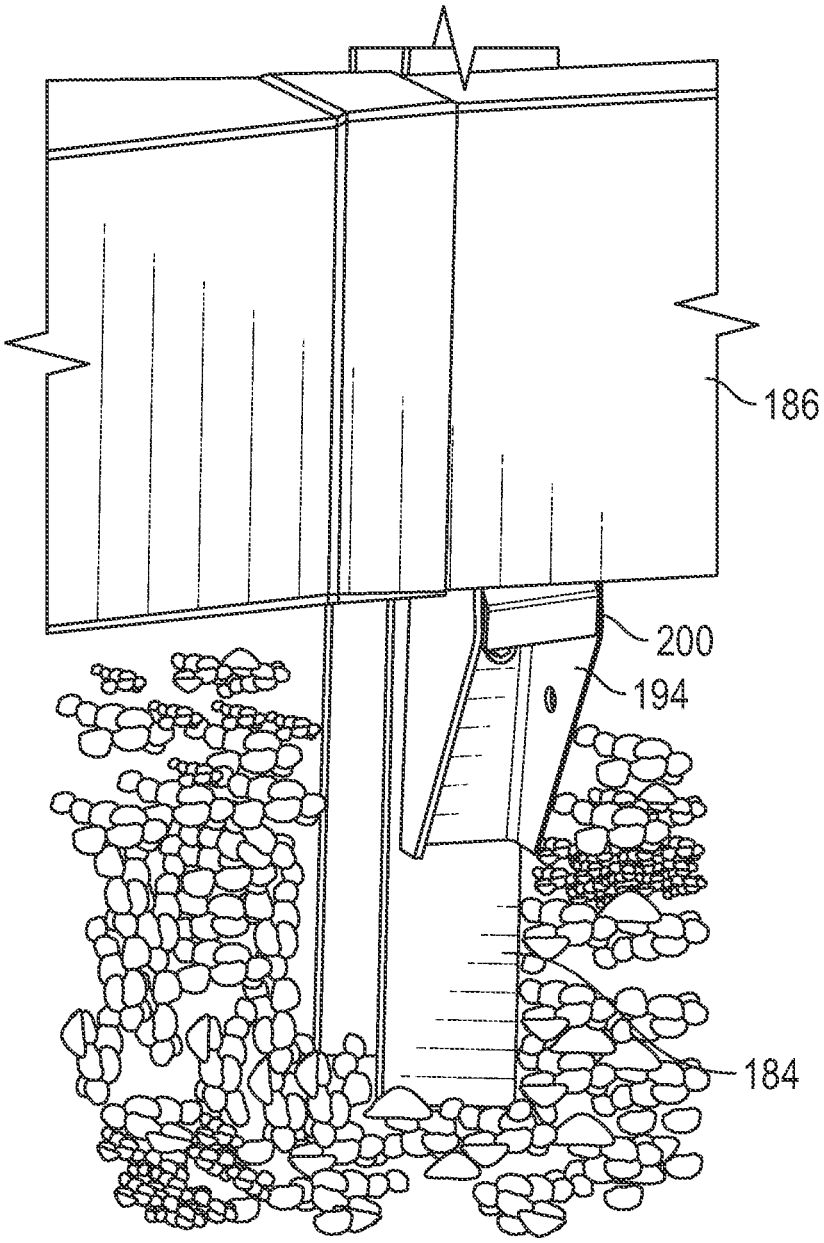
FIG. 31 shows a perspective view of the shelf bracket of FIG. 30, a guardrail terminal, and a post in accordance with an exemplary embodiment of the present disclosure.
Figure 32:
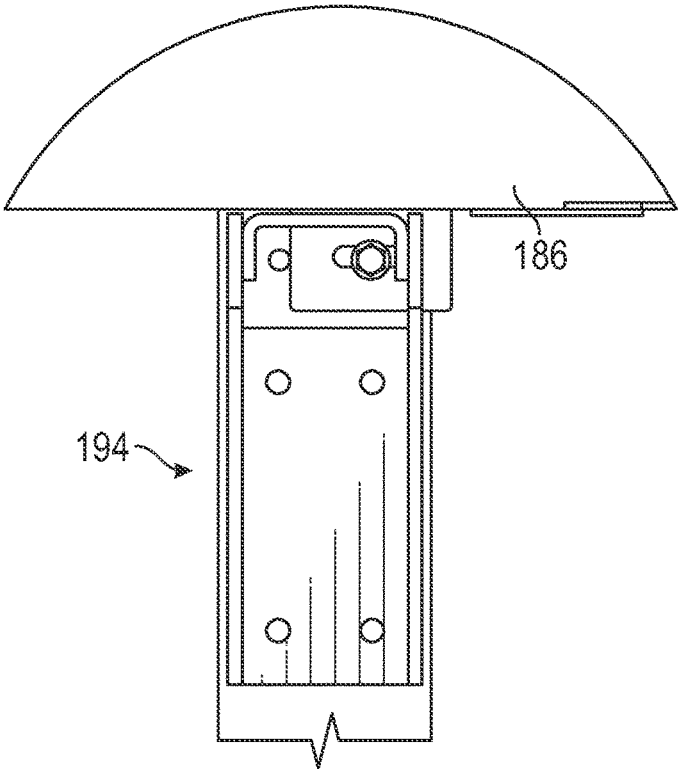
FIG. 32 shows a view of a portion of the shelf bracket, guardrail terminal, and post of FIG. 31.
Figure 33:
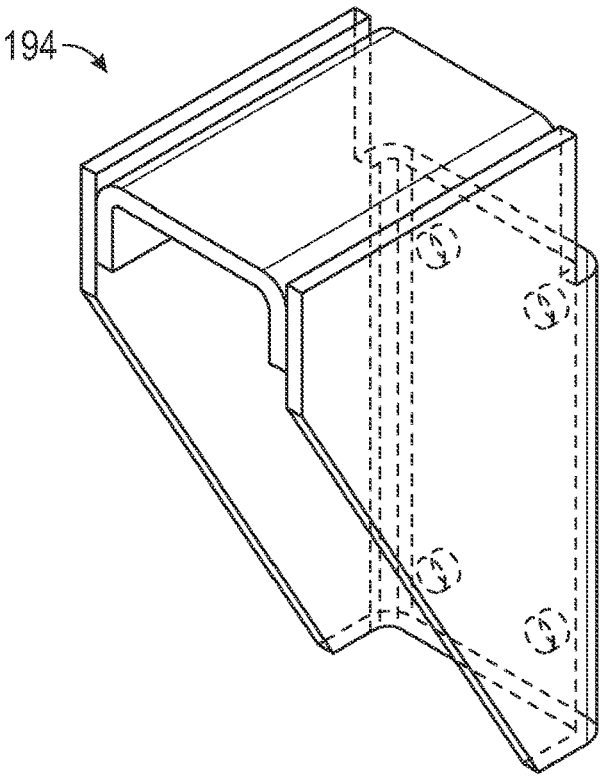
FIG. 33 shows a perspective view of the shelf bracket of FIG. 30.
Figure 34:
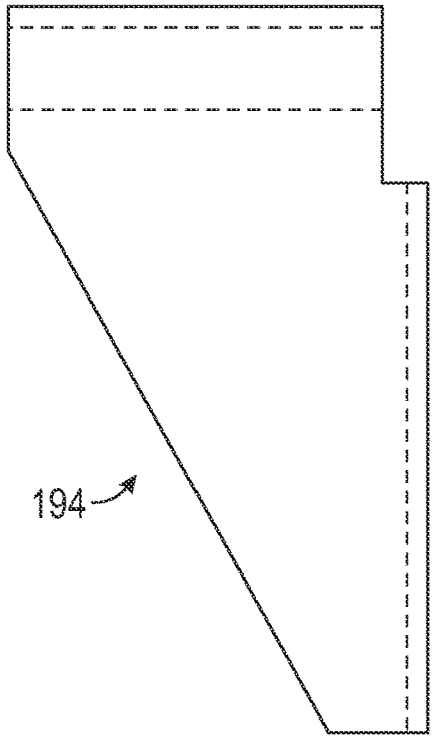
FIG. 34 shows a side elevation view of the shelf bracket of FIG. 30.
Figure 35:
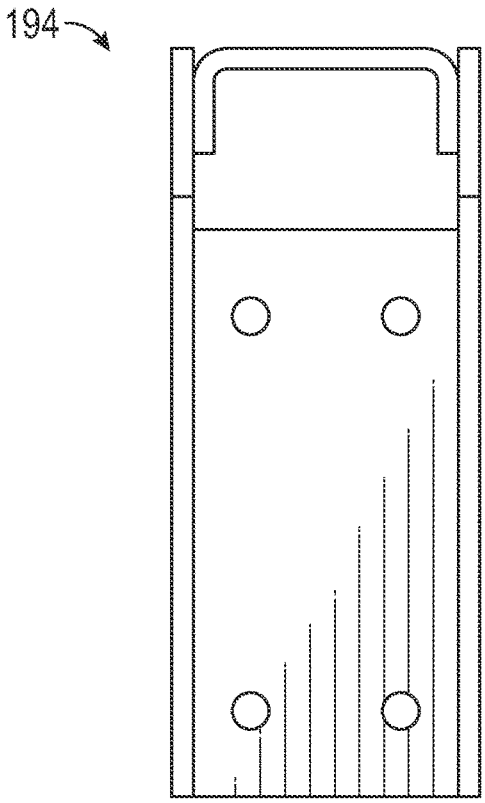
FIG. 35 shows a front elevation view of the shelf bracket of FIG. 30.
Figure 36:
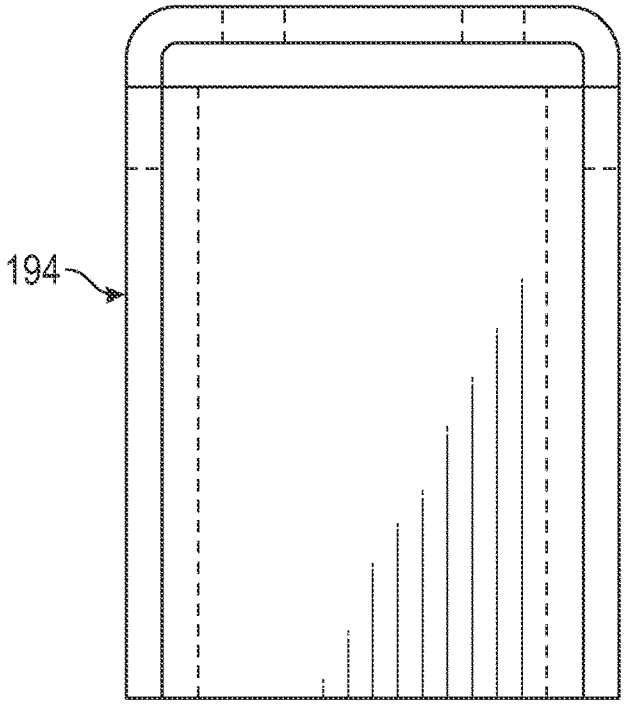
FIG. 36 shows a view of a portion of the shelf bracket of FIG. 30.
Figure 37:
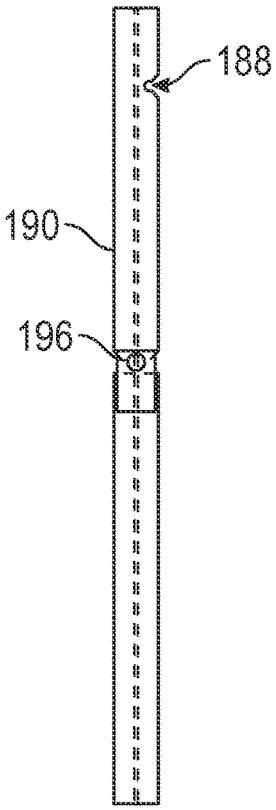
FIG. 37 shows a view of a guardrail post in accordance with an exemplary embodiment of the present disclosure.
Figure 38:
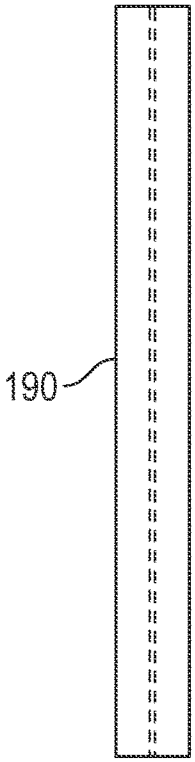
FIG. 38 shows a view of a bottom portion of the guardrail post of FIG. 37.
Figure 39:
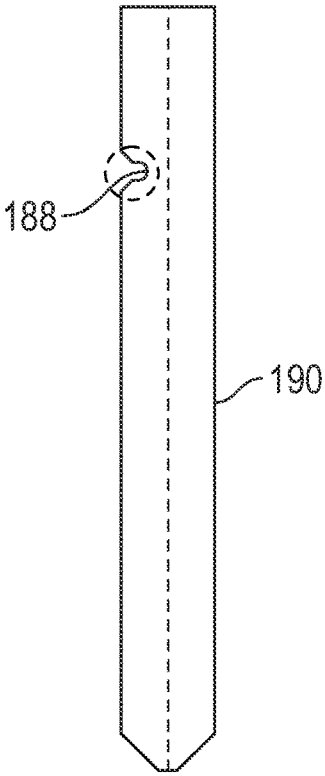
FIG. 39 shows a view of an upper portion of the guardrail post of FIG. 37.
Figure 40:
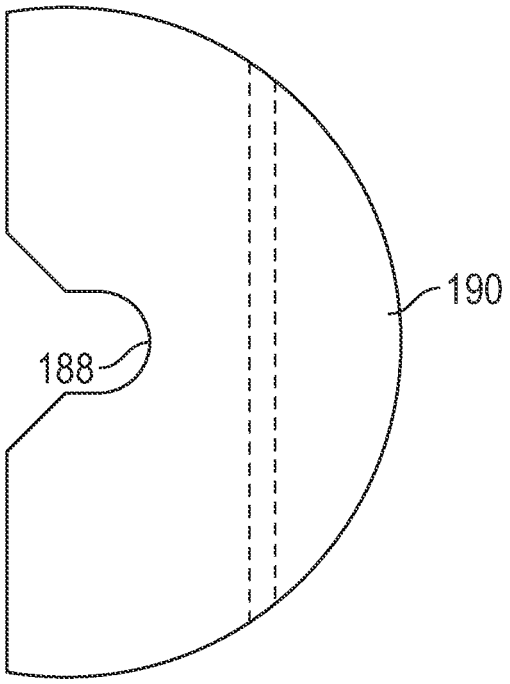
FIG. 40 shows a view of a notched fastener opening in the guardrail post of FIG. 37.
Figure 41:
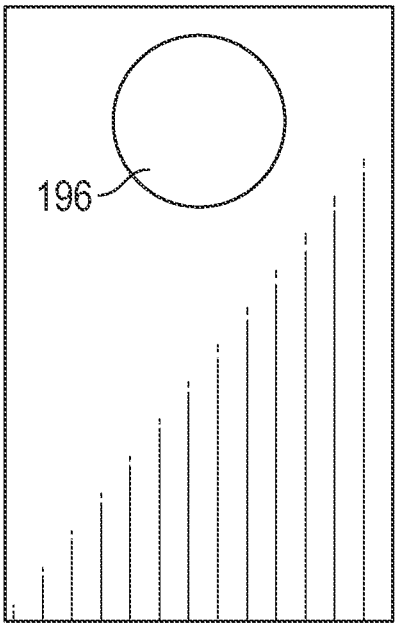
FIG. 41 shows a view of a side plate of the guardrail post of FIG. 37.
Figure 42:
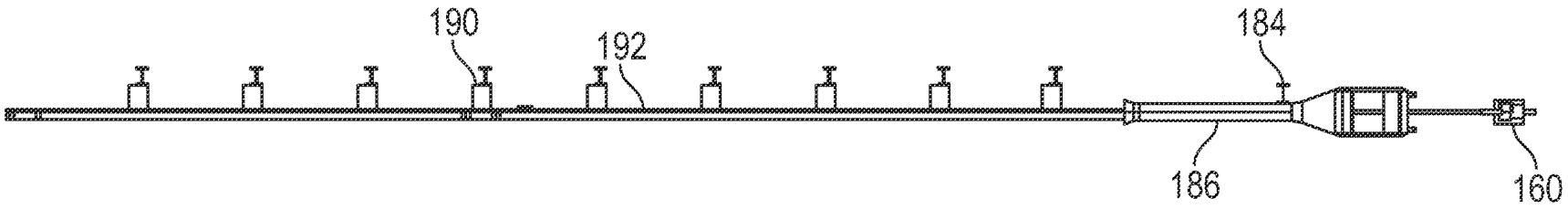
FIG. 42 shows a top view of a guardrail assembly in accordance with an exemplary embodiment of the present disclosure.

Referring to FIGS. 23 and 24, guardrail assembly 120 is shown. Guardrail assembly 120 includes guardrail terminal 80 or 82, first guardrail 108, and second guardrail 106. In an embodiment, second guardrail 106 is formed of 10-ga W-beam rail. At a first location 126 that is a first spaced distance from guardrail terminal 80 or 82, which is positioned such that first guardrail 108 extends into opening 66, a cable 122 with a swaged button 124 compressed thereon is directly attached to first guardrail 108 by welding button 124 to guardrail 108. A second spaced distance between swaged buttons 124 is less than a distance from first location 126 to splice 110. At a second spaced distance from guardrail terminal 80 or 82 that is greater than the first spaced distance, staggered splice 110 connects first guardrail 108 to second guardrail 106. A second swaged button 124 connects cable 122 to guardrail 108 at a second location 128 that is at a third spaced distance such that the total spaced distance of the first and second spaced distances is less than the distance between guardrail terminal 80 or 82 and stagger splice 10.

As noted above, first guardrail 108 is formed of 10-gauge rail, which is about 0.135 inches thick. Conventional material is 12 gauge (0.105 inches thick). The thicker material increases barrier capacity, defined as the ability to control movement of a vehicle without rupture of the barrier that causes the release of the vehicle, and this change in thickness increases the stiffness of guardrail assembly 120. The additional stiffness enhances capturing and stopping a vehicle before it gates through, i.e., passes through, to a backside of guardrail assembly 120.

Figure 47:
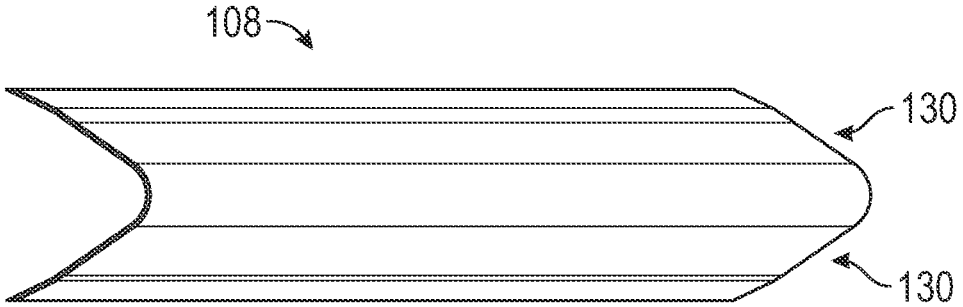
FIG. 47 shows a side view of a portion of guardrail that interfaces with any of the guardrail terminals disclosed herein.

A hybrid system can include guardrail 108. Along cable 122, steel buttons 124 are swaged onto cable 122. Buttons 124 are welded to guardrail 108 at intervals along the length of guardrail 108. Additional buttons 124, including even the two swaged buttons 124 shown in FIG. 23, provide additional strength in the guardrail assembly 120 for angled impacts. The configuration of guardrail assembly 120 also provides a secondary rail element, i.e., cable 122, to carry tension if guardrail 108 ruptures. Referring to FIG. 47, guardrail 108 has chamfered corners 130 on the top and bottom sides of guardrail 108 on the upstream end, which is the end that feeds into, for example, terminal head 80 and 82. These chamfered corners interact with deflector plate 24 to minimize gouging into and snagging on deflector plate 24 and reduce the propensity for longitudinal tears to develop along the axis of guardrail 108.

Referring to FIGS. 23 and 24, guardrail 108 can interface with a guardrail post 132 by way of a block 134, which may be formed of wood. Block 134 is directly attached to guardrail post 132 by fasteners. Block 134 includes a groove or channel 136 and button 124 fits into groove 136. Groove 136 vertically captures button 124, thus helping to vertically support buttons 124 via mechanical interlock.

Figure 48:
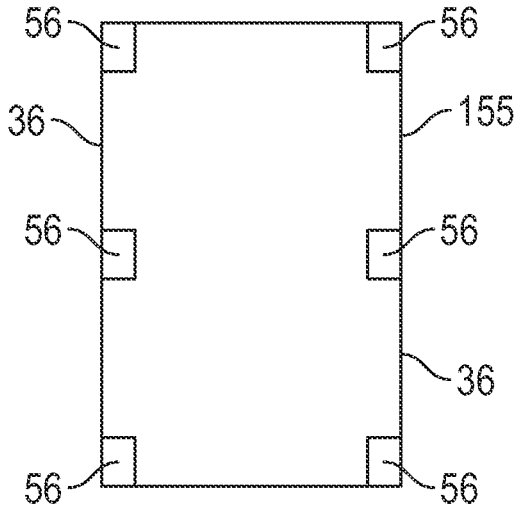
FIG. 48 shows a view of a reduced width impact face in accordance with an exemplary embodiment of the present disclosure.

Vehicle engagement is important for proper performance in a non-gating event. Vehicle engagement is also relevant for stopping an impacting vehicle regardless of gating or non-gating. Vehicle engagement is important for shallow-angle impacts, for example. Testing has shown that for modern vehicles a wide impact plate, while stable and suitable as a gating device, may not push deeply enough into an impacting vehicle to solidly connect the vehicle and the guardrail terminal. Accordingly, the width of the impact face, which can also be called an impact plate, can be narrowed by several inches compared to a height of the impact face. Reducing the cross-sectional area by 10-20% by reducing a width of an impact face, such as impact face 155 shown in FIG. 48, enables several more inches of push by engagement pins 56 and, if present, side walls 36 into an engine compartment. This deeper push into the engine compartment enables vehicle components to wrap around the guardrail terminal, in other words, to form themselves around the guardrail terminal, to form a solid connection. Through this connection, the perpendicular and parallel forces from the guardrail terminal can be efficiently transmitted to the vehicle both slowing it down and turning it back to the road. In an exemplary embodiment, impact face 155 can be 14 inches wide and about 28 inches tall, with an aspect ratio of approximately 2:1, and such dimensions assist engagement pins 56 and side walls 36 to press into an impacting vehicle.

FIGS. 25-29 show views of an anchor post connection 160 in accordance with an exemplary embodiment of the present disclosure. An anchor post 166 is driven or set into the ground such that an assembly of plates 162 is flush with a level of ground 164. Assembly of plates 162 sits atop post 166 and includes a bearing surface 168 on the upstream side. A threaded rod 170 connected to cable 122 by a swage 172 at an end of cable 122 fits into a U-shaped slot 174 in bearing surface 168. Threaded rod 170 secures cable 122 to the upstream side of bearing surface 168. A bracket 176 fits inside walls 178 of assembly of plates 162. This bracket creates a closed channel 180 for threaded rod 170 to rest and it holds threaded rod 170 of the cable end approximately parallel to ground 164. Bracket 176 is secured in place with fasteners 182 that are designed to shear and release threaded rod 170 and, accordingly, cable 122 from connection 160 in reverse-direction impacts.

Figure 43:
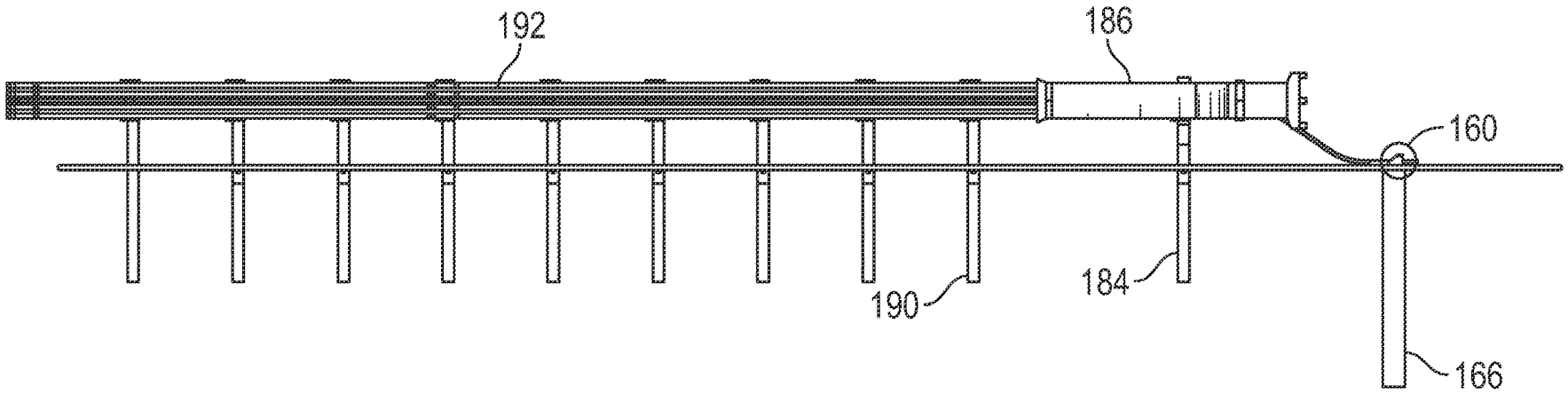
FIG. 43 shows a side view of the guardrail assembly of FIG. 42.
Figure 44:
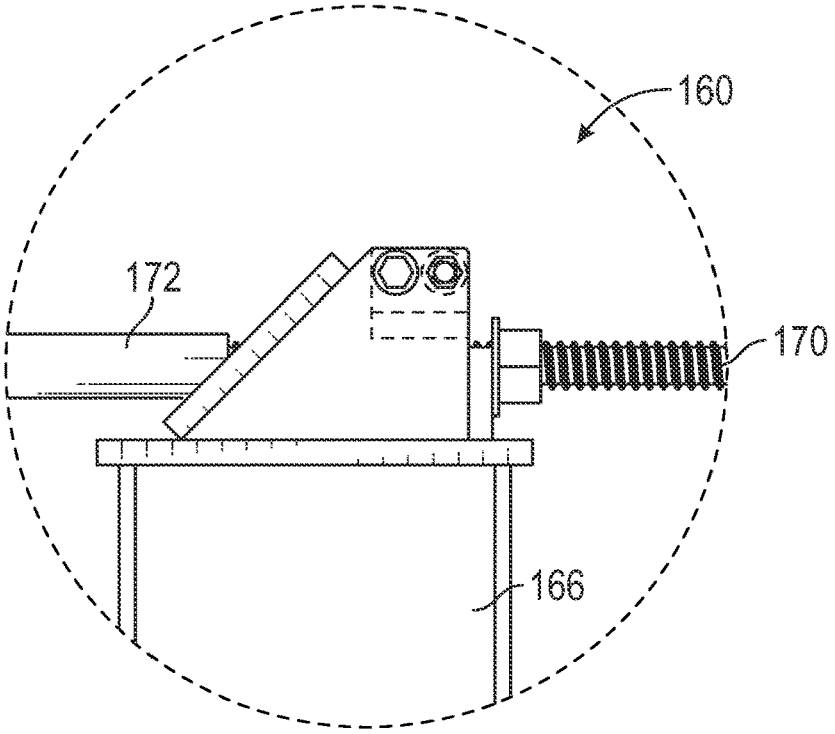
FIG. 44 shows a detailed view of an anchor post connection in accordance with an exemplary embodiment of the present disclosure.
Figure 45:
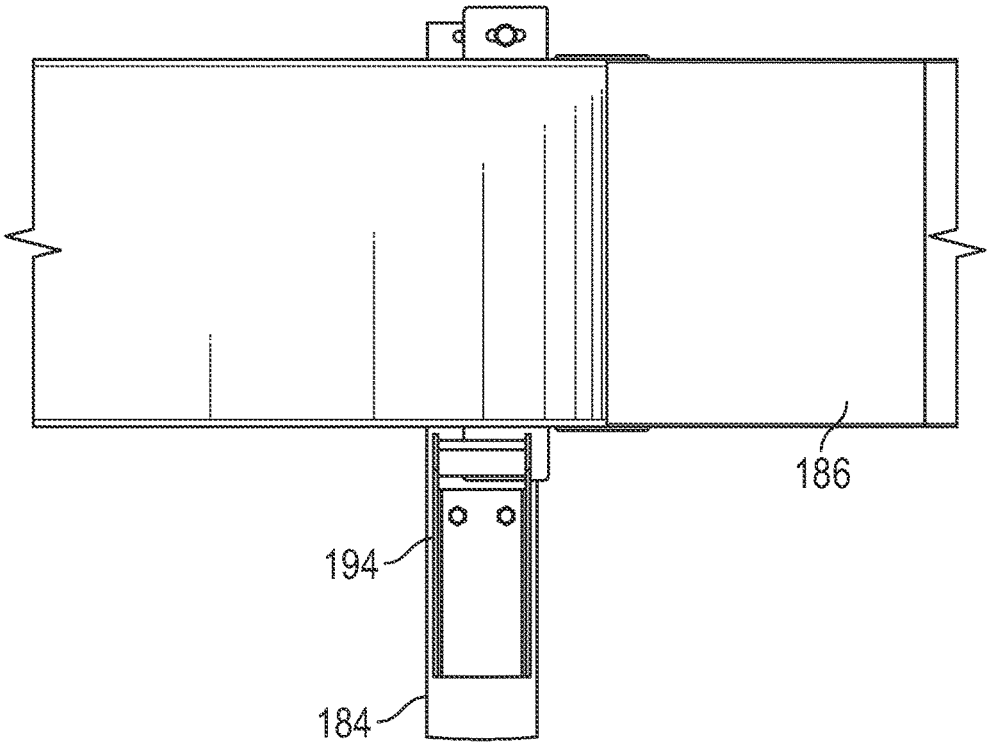
FIG. 45 shows a view of a shelf bracket and guardrail terminal of the guardrail assembly of FIG. 42.
Figure 46:
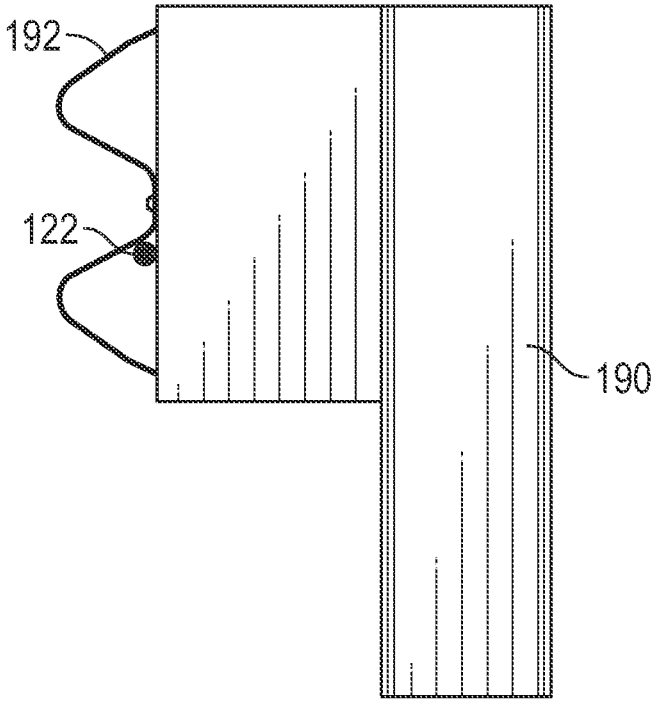
FIG. 46 shows a view of a post and guardrail of the guardrail assembly of FIG. 42.

Anchor post 166 is a custom W8×15 wide-flange I-beam assembly. It is 6' 6" long and has anchor post connection 160 welded to the top of the beam. Post 166 is preferably installed such that anchor post connection 160 is flush with the ground. When properly installed, anchor post connection 160 is the only visible portion of anchor post 166. Anchor post connection 160 is designed to provide a fixed connection for cable 122 during head-on and redirecting impacts while also being able to release cable 122 on reverse impacts. Under reverse impact conditions, anchor cable 122 is designed to release either by shearing fasteners 182 or by breaking threaded rod 170. Anchor post 166 is a standard post spacing away from post 184 that supports guardrail terminal 186 (see FIG. 43), which can be any of the guardrail terminals disclosed herein. Cable 122 is routed through guardrail terminal 186 and attached to anchor post connection 160. Fasteners 182 are staggered relative to one another, creating a sequencing fracture of bolts rather than a simultaneous fracturing. This configuration reduces impulsive loading on anchor post connection 160.

Referring to FIGS. 31-46, a post shelf 200 is bolted to first post 184 underneath guardrail terminal 186. Guardrail terminal 186 is bolted to first post 184 with small bolts, allowing it to separate easily at the beginning of a crash where guardrail terminal 186 is struck nearly head-on. However, these small bolts may not always maintain a connection guardrail terminal 186 and first post 184 during an impact with the downstream guardrail. In such a scenario, post shelf 200 holds up guardrail terminal 186, preventing it from falling to the ground. If guardrail terminal 186 falls to ground 164, so does the guardrail, and it becomes possible for the vehicle to override the guardrail.

Referring to FIGS. 37-46, in guardrail posts 190, there is a post-bolt slot 188 that receives a post bolt, connecting guardrail 192 to post 190. As guardrail terminal 186 slides along guardrail 192, the post bolts are supposed to separate from guardrail 192, as they do for most guardrail terminals. Slot 188, however, is unique. Instead of a closed hole, slot 188 remains open on the upstream side, allowing the post bolt to slide out and disconnect from post 190 in the event that the post bolt does not pull through guardrail 192.

Slot 188 can also be tapered by chamfering the corners, allowing even easier disconnection. Thus, the corners of the slots, or the edges themselves, are angled up and away from the centerline of the slot. The slot allows for the bolt to evacuate and separate from the post quickly if the bolt does not pull through the guardrail slot. This configuration reduces the tendency for large impulsive loading. The taper and/or chamfer is situated such that the nut has enough surface to engage without slippage during installation. This configuration allows for a tight enough grip to apply a proper installation tension through the bolt that clamps the guardrail to the post.

Shelf bracket 194 provides a strong, stable support for guardrail terminal 186 during a collision with impact face or plate, thereby keeping guardrail 192 high enough to prevent the impacting vehicle from overriding guardrail 192. Shelf bracket 194 can be bolted to first post 184 prior to installing guardrail terminal 186, guardrail 192, and other elements, and can be used as a support during the installation process.

Guardrail post 190 spacing has been standardized at 75 inches on center. This spacing is referred to as standard post spacing. When the post spacing is reduced to 37.5 inches on center, it is referred to as "half post spacing." Reducing the spacing between posts 190 helps minimize lateral deflection of the vehicle. Reducing spacing is a tactic used in a transition from the semi-rigid corrugated beam barrier to the rigid concrete barrier. Without such a transition, vehicles could deflect a guardrail far enough that they would collide head-on with the blunt end of the concrete. The use of half post spacings was used for the first time in the non-gating terminal of the present disclosure, which is the opposite end of the guardrail system, relative to the traditional transition usage near the concrete attachment. This configuration produces twice as many posts as a standard post spacing in the same span and could potentially lead to vehicle stability problems from the extra impulsive loads. However, in combination with the half post spacing shown in FIGS. 42 and 43, non-gating guardrail terminal 186 uses plug-welded posts. These posts rotate about the ground line very easily when struck from the side (the direction from which non-gating guardrail terminal 186 would be coming). The strength of the posts is controlled by the diameter of plug weld 196.

While various embodiments of the disclosure have been shown and described, it should be understood that these embodiments are not limited thereto. The embodiments may be changed, modified, and further applied by those skilled in the art. Further, elements of embodiments can be interchanged and combined to create new embodiments. Therefore, these embodiments are not limited to the detail shown and described previously, but also include all such changes and modifications.

What is claimed is:

1. A guardrail terminal, comprising:

a first end, the first end including an opening configured to accept a corrugated shaped guardrail;

a second end;

an impact face positioned at the second end, the impact face including a front surface facing away from the first end, a back surface facing toward the first end, and a bottom surface;

a top plate extending from the first end to the impact face;

a bottom plate extending from the first end toward the impact face;

an opening formed between the bottom plate and the back surface of the impact face;

a pair of side plates extending from the top plate to the bottom plate on opposite sides of the top plate and the bottom plate; and a deflector attached to the top plate and to a lower location on the back surface of the impact face, the deflector extending at an angle of at least 15 degrees downwardly from the top plate toward the back surface of the impact face.

2. The guardrail terminal of claim 1, wherein the angle of the deflector is in a range of 15 degrees to 45 degrees.

3. The guardrail terminal of claim 1, wherein the deflector extends through the opening.

4. The guardrail terminal of claim 1, wherein the impact face includes a plurality of side walls formed about a periphery of the front surface.

5. The guardrail terminal of claim 1, wherein the impact face includes a plurality of engagement pins extending away from the front surface.

6. The guardrail terminal of claim 5, wherein the impact face includes a plurality of corners, and one engagement pin of the plurality of engagement pins is positioned at each of the plurality of corners.

7. The guardrail terminal of claim 6, wherein two engagement pins of the plurality of engagement pins are positioned on adjacent corners of the plurality of corners, each of the two engagement pins includes a first end oriented towards the impact face and a second end oriented away from the impact face, and the second end includes an angled face, and the angled faces of the two engagement pins face towards each other.

8. The guardrail terminal of claim 5, including at least one engagement pin positioned on a periphery of the front surface between two engagement pins of the plurality of engagement pins positioned at two adjacent corners of the plurality of corners.

9. The guardrail terminal of claim 5, wherein at least one of the plurality of engagement pins includes a first end oriented towards the impact face and a second end oriented away from the impact face, and the second end includes an angle.

10. The guardrail terminal of claim 9, wherein the angle of the second end of the at least one of the plurality of engagement pins is at least 45 degrees.

11. The guardrail terminal of claim 1, wherein the deflector is attached to each of the side plates.

12. A guardrail terminal, comprising:

a first end;

a second end;

a plurality of walls extending between the first end and the second end, including a top wall and a bottom wall;

an opening formed in the first end by the plurality of walls;

a passage having a vertical width formed by the plurality of walls extending from the opening to the second end; and an angled deflector attached to the top wall and extending across the entire vertical width of the passage from the top wall toward the second end.

13. The guardrail terminal of claim 12, wherein an opening is formed between the bottom wall and the second end, and the angled deflector extends through the opening.

14. The guardrail terminal of claim 13, including an impact face positioned at the second end, the impact face including a front surface facing away from the angled deflector and a back surface facing toward the angled deflector, and the angled deflector is attached to the impact face at a location adjacent to a bottom of the back surface of the impact face.

15. The guardrail terminal of claim 14, including a plurality of engagement pins attached to and extending away from the front surface of the impact face.

16. The guardrail terminal of claim 12, wherein the angled deflector extends at an angle in a range of 15 degrees to 45 degrees from horizontal.

17. The guardrail terminal of claim 12, wherein the plurality of walls includes a pair of side walls extending from the top wall to the bottom wall, and the deflector is attached to each of the side walls.

18. The guardrail terminal of claim 12, wherein the plurality of walls forms a feeder chute for a corrugated guardrail, and the plurality of walls forming the opening at the first end include flared surfaces that angle away from the opening.

19. A guardrail terminal, comprising:

a plurality of walls configured to peripherally enclose a guardrail, the plurality of walls extending in a longitudinal direction along a longitudinal axis;

a plate extending in a direction transverse to the longitudinal direction and connected to the plurality of walls, the plate including a front surface;

at least one side wall connected to the plate and extending in a first direction away from the plurality of walls; and a plurality of engagement pins supported by at least one of the plate and the at least one side wall, the plurality of engagement pins extending away from the plate in the first direction, and each of the plurality of engagement pins overlapping the front surface in a view along the longitudinal axis.

20. The guardrail terminal of claim 19, wherein an end of at least some of the plurality of engagement pins that is a spaced distance from the front surface of the plate includes an angle.

* * * * *